US011365588B2

(12) United States Patent
Chen et al.

(10) Patent No.: US 11,365,588 B2
(45) Date of Patent: Jun. 21, 2022

(54) DOWNHOLE DRILLING TOOL WITH DEPTH OF CUT CONTROLLER ASSEMBLIES INCLUDING ACTIVATABLE DEPTH OF CUT CONTROLLERS

(71) Applicant: Halliburton Energy Services, Inc., Houston, TX (US)

(72) Inventors: Shilin Chen, Montgomery, TX (US); Gregory Christopher Grosz, Magnolia, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 41 days.

(21) Appl. No.: 16/970,287

(22) PCT Filed: Mar. 26, 2018

(86) PCT No.: PCT/US2018/024328
§ 371 (c)(1),
(2) Date: Aug. 14, 2020

(87) PCT Pub. No.: WO2019/190456
PCT Pub. Date: Oct. 3, 2019

(65) Prior Publication Data

US 2021/0079733 A1 Mar. 18, 2021

(51) Int. Cl.
*E21B 10/43* (2006.01)
*E21B 10/55* (2006.01)
(Continued)

(52) U.S. Cl.
CPC ..... *E21B 10/43* (2013.01); *E21B 10/55* (2013.01); *E21B 10/567* (2013.01); *E21B 10/62* (2013.01)

(58) Field of Classification Search
CPC ..... E21B 10/43; E21B 10/55; E21B 10/62; E21B 10/567; E21B 10/54; E21B 10/42
See application file for complete search history.

(56) References Cited

U.S. PATENT DOCUMENTS

2016/0215568 A1 7/2016 Chen et al.
2017/0175455 A1 6/2017 Jain et al.
(Continued)

FOREIGN PATENT DOCUMENTS

WO WO-2016043755 A1 * 3/2016 ..... E21B 10/62
WO 2016-140663 9/2016

OTHER PUBLICATIONS

International Search Report received for PCT Patent Application No. PCT/US2018/024328, dated Dec. 21, 2018; 3 pages.
(Continued)

*Primary Examiner* — Caroline N Butcher
(74) *Attorney, Agent, or Firm* — Thomas Rooney; C. Tumey Law Group PLLC

(57) ABSTRACT

A drill bit includes a bit body defining a rotational axis, a plurality of blades on the bit body, a plurality of cutting elements on the plurality of blades, each cutting element defining a sweep profile about the rotational axis, a first depth of cut controller (DOCC) movably secured to one of the plurality of blades and movable in response to contact by a formation when drilling, and a second DOCC movably secured to the one of the plurality of blades, the second DOCC coupled to the first DOCC such that movement of the first DOCC changes a height of the second DOCC relative to a height of the first DOCC.

21 Claims, 13 Drawing Sheets

(51) Int. Cl.
*E21B 10/567* (2006.01)
*E21B 10/62* (2006.01)

(56) References Cited

U.S. PATENT DOCUMENTS

| | | | |
|---|---|---|---|
| 2017/0275951 | A1 | 9/2017 | Thomas |
| 2018/0030786 | A1 | 2/2018 | Dunbar et al. |

OTHER PUBLICATIONS

Written Opinion received for PCT Patent Application No. PCT/US2018/024328, dated Dec. 21, 2018; 4 pages.
Jain, Jayesh R. et al., "A Step Change in Drill-Bit Technology with Self-Adjusting Polycrystalline-Diamond-Compact Bits," SPE Drilling & Compliance, pp. 286-294, Dec. 2016, 9 pages.

* cited by examiner

DOWNHOLE DRILLING TOOL WITH DEPTH OF CUT CONTROLLER ASSEMBLIES INCLUDING ACTIVATABLE DEPTH OF CUT CONTROLLERS

RELATED APPLICATIONS

This application is a U.S. National Stage Application of International Application No. PCT/US2018/024328 filed Mar. 26, 2018, which designates the United States.

TECHNICAL FIELD

The present disclosure relates generally to downhole drilling tools and, more particularly, to a downhole drilling tool with depth of cut controller assemblies including activatable or engageable depth of cut controllers.

BACKGROUND

Various types of tools are used to form wellbores in subterranean formations for recovering hydrocarbons such as oil and gas. Examples of such tools include rotary drill bits, hole openers, reamers, and coring bits. Rotary drill bits include, but are not limited to, roller cone drill bits and fixed cutter drill bits. A fixed cutter drill bit typically includes multiple blades each having multiple cutting elements.

In a typical drilling application, a drilling tool, such as a drill bit, is coupled to the lower end of a drill string. The drill string includes a series of elongated tubular segments connected end-to-end. When the drill string is rotated, cutting elements on the drilling tool in contact with the formation scrape and gouge the formation to form a wellbore. In the case of a fixed-cutter bit, the diameter of the wellbore formed by the drill bit may be defined by the cutting elements disposed at the largest outer diameter of the drill bit.

A drilling tool may also include one or more depth of cut controllers (DOCCs). A DOCC is a physical structure configured to control the amount that the cutting elements of the drilling tool cut into or engage with a geological formation. A DOCC may provide sufficient surface area to engage with the formation without exceeding the compressive strength of the formation and take the load off of or away from the cutting elements limiting their depth or engagement. Conventional DOCCs are fixed on the drilling tool by welding, brazing, or any other suitable attachment method, and are configured to engage with the formation to maintain a pre-determined depth of cut.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
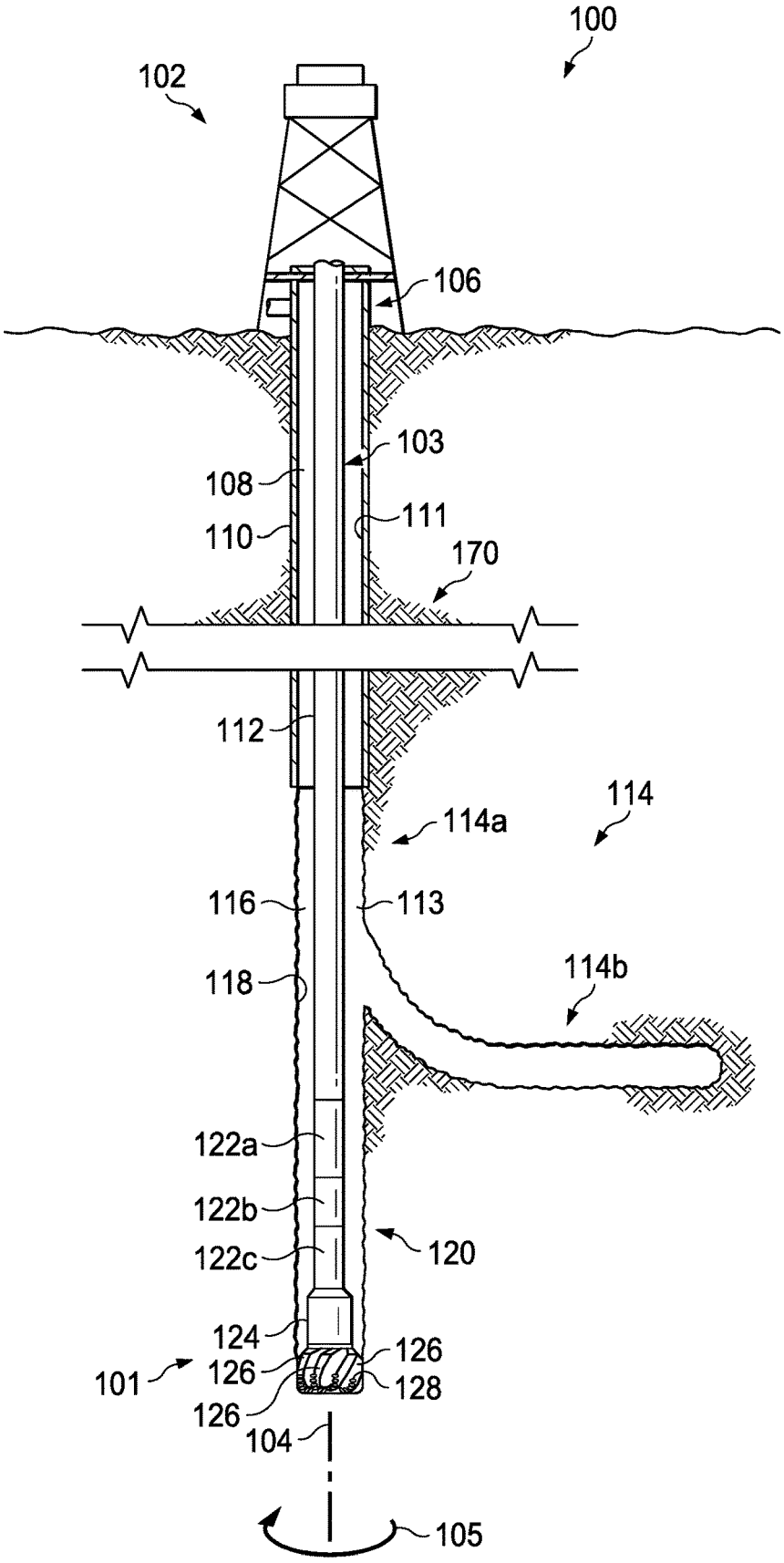
FIG. 1 is an elevation view of an example drilling system used in a wellbore environment.

The present disclosure relates to a drill bit including a depth of cut controller (DOCC) assembly that has primary and secondary DOCCs. The DOCC assembly may be designed to engage with a subterranean formation and control the amount that the cutting elements on the drill bit cut into or engage with that formation. For example, a drill bit may drill through geological layers of varying compressive strengths during a drilling operation, which results in varying forces acting on the cutting elements of the drill bit based on the varying compressive strengths of the formation. Additionally, a drill bit may operate at various operational parameters, including but not limited to revolutions per minute (RPM) and weight on bit (WOB), and fluctuations in these parameters, whether intentional or resulting from varying wellbore conditions, may result in varying forces acting on the cutting elements of the drill bit. In some periods of the drilling operation, the forces acting on the drill bit may remain low enough, e.g., below a force threshold, such that a depth of cut of a drill bit may be controlled only with the primary DOCC in the DOCC assembly. In such periods of the drilling operation where the forces acting on the drill bit remain below a force threshold, the secondary DOCC may be disposed such that the secondary DOCC has a lesser height relative to the drill bit or DOCC assembly housing than a height of the primary DOCC relative to the drill bit or DOCC assembly housing and the secondary DOCC does not engage the formation. In other periods of the drilling operation, large forces, e.g. forces approaching a force threshold, may act on the primary DOCC in the DOCC assembly and cause the primary DOCC to increase the height of the secondary DOCC relative to the height of the primary DOCC such that, when the force threshold is reached, the secondary DOCC contacts and engages with the formation. Increasing the height of the secondary DOCC such that both the primary DOCC and the secondary DOCC have substantially the same height increases the surface area of the DOCC assembly that engages with the subterranean formation because both the primary DOCC and the secondary DOCC contact and engage the formation. Therefore, increasing the height of the secondary DOCC provides a greater amount of depth of cut control for corresponding cutting elements, while decreasing the height of the secondary DOCC relative to the height of the primary DOCC provides a lesser amount of depth of cut control.

As forces that exceed a force threshold act on the drill bit, the primary DOCC, alone, may provide less than desired depth of cut control at that moment, because the limited surface area of the primary DOCC may not be able to fully counteract the forces at that moment. Thus, the ability of the DOCC assembly to supplement the primary DOCC with the secondary DOCC under certain loading conditions allows the DOCC assembly to provide a variable amount of depth of cut control to respond to dynamically changing bit loading. Intermittently increasing the total DOCC surface area in response to exceeding a certain force or loading threshold on the drill bit results in a varying amount of depth of cut control to allow for effective use of the drill bit and DOCC assemblies in drilling operations that involve these relatively high forces, e.g., forces exceeding a force threshold. Embodiments of the present disclosure and its advantages are best understood by referring to FIGS. 1-8, where like numbers are used to indicate like and corresponding parts.

FIG. 1 illustrates an elevation view of an example embodiment of drilling system 100 used in a wellbore environment. Drilling system 100 may include well surface or well site 106. Various types of drilling equipment such as a rotary table, drilling fluid pumps and drilling fluid tanks (not expressly shown) may be located at well surface or well site 106. For example, well site 106 may include drilling rig 102 that may have various characteristics and features associated with a "land drilling rig." However, downhole drilling tools incorporating teachings of the present disclosure may be satisfactorily used with drilling equipment located on offshore platforms, drill ships, semi-submersibles and drilling barges (not expressly shown).

Drilling system 100 may also include drill string 103 associated with drill bit 101 that may be used to form a wide variety of wellbores or bore holes such as generally vertical wellbore 114*a* or generally horizontal wellbore 114*b* or any combination thereof. Various directional drilling techniques and associated components of bottom-hole assembly (BHA) 120 of drill string 103 may be used to form horizontal wellbore 114*b*. For example, lateral forces may be applied to BHA 120 proximate kickoff location 113 to form generally horizontal wellbore 114*b* extending from generally vertical wellbore 114*a*. Directional drilling may refer to drilling a wellbore or portions of a wellbore that extend at a desired angle or angles relative to vertical. The desired angles may be greater than normal variations associated with vertical wellbores. Directional drilling may also be described as drilling a wellbore deviated from vertical. Horizontal drilling may refer to drilling in a direction approximately ninety degrees (90°) from vertical.

BHA 120 may include a wide variety of components configured to form wellbore 114. For example, components 122*a*, 122*b* and 122*c* of BHA 120 may include, but are not limited to, drill bits (e.g., drill bit 101), coring bits, drill collars, rotary steering tools, directional drilling tools, downhole drilling motors, reamers, hole enlargers or stabilizers. The number and types of components 122 included in BHA 120 may depend on anticipated downhole drilling conditions and the type of wellbore that will be formed by drill string 103 and rotary drill bit 101. BHA 120 may also include various types of well logging tools (not expressly shown) and other downhole tools associated with directional drilling of a wellbore. Examples of logging tools and/or directional drilling tools may include, but are not limited to, acoustic, neutron, gamma ray, density, photoelectric, nuclear magnetic resonance, rotary steering tools and/or any other commercially available well tool. Further, BHA 120 may also include a rotary drive (not expressly shown) connected to components 122*a*, 122*b* and 122*c* and which rotates at least part of drill string 103 together with components 122*a*, 122*b* and 122*c*.

Drilling system 100 may also include rotary drill bit ("drill bit") 101. Drill bit 101, discussed in further detail in FIG. 2, may include one or more blades 126 that may be disposed outwardly from exterior portions of rotary bit body 124 of drill bit 101. Blades 126 may be any suitable type of projections extending outwardly from rotary bit body 124. Drill bit 101 may rotate with respect to bit rotational axis 104 in a direction defined by directional arrow 105. Blades 126 may include one or more cutting elements 128 disposed outwardly from exterior portions of each blade 126. Blades 126 may also include one or more depth of cut controllers (not expressly shown) configured to control the depth of cut of cutting elements 128, which is the amount that the cutting elements of the drilling tool cut into or engage a geological formation during a drilling operation. Blades 126 may further include one or more gage pads (not expressly shown) disposed on blades 126. Drill bit 101 may be designed and formed in accordance with teachings of the present disclosure and may have many different designs, configurations, and/or dimensions according to the particular application of drill bit 101.

Drill bit 101 may be used to drill through geological formation 170 to form wellbore 114. Geological formation 170 may include various layers with different geological characteristics. For example, geological formation 170 may have a relatively low compressive strength in the upper portions (e.g., shallower drilling depths) of the formation and a relatively high compressive strength in the lower portions (e.g., deeper drilling depths) of the formation. Further examples of layers of formation 170 are described in greater detail below with respect to FIG. 3. As drill bit 101 drills through formation 170, various levels of depth of cut control may be required. For example, in periods of the drilling operation where drill bit 101 drills through portions of formation 170 with a relatively high compressive strength or where drill bit 101 transitions between portions of formation 170 with different compressive strengths, greater depth of cut control may be needed. Additionally, in periods of the drilling operation where drill bit 101 is being operated at relatively high RPM or WOB settings, greater depth of cut control may be needed. Depth of cut controller assemblies with primary and secondary depth of cut controllers, as described in greater detail with respect to FIGS. 4-6, may provide varying depth of cut control for drill bit 101 during the various periods of the drilling operation.

Wellbore 114 may be defined in part by casing string 110 that may extend from well surface 106 to a selected downhole location in geological formation 170. Portions of wellbore 114, as shown in FIG. 1, that do not include casing string 110 may be described as open hole. Various types of drilling fluid may be pumped from well surface 106 through drill string 103 to attached drill bit 101. The drilling fluids may be directed to flow from drill string 103 to respective nozzles (depicted as nozzles 156 in FIG. 2) passing through rotary drill bit 101. The drilling fluid may be circulated back to well surface 106 through annulus 108 defined in part by outside diameter 112 of drill string 103 and inside diameter 118 of wellbore 114*a*. Inside diameter 118 may be referred to as the sidewall of wellbore 114*a*. Annulus 108 may also be defined by outside diameter 112 of drill string 103 and inside diameter 111 of casing string 110. Open hole annulus 116 may be defined by sidewall 118 of wellbore 114*a* and outside diameter 112 of drill string 103.

Uphole and downhole may be used to describe the location of various components of drilling system 100 relative to the bottom or end of wellbore 114 shown in FIG. 1. For example, a first component described as uphole from a second component may be further away from the end of wellbore 114 than the second component. Similarly, a first component described as being downhole from a second component may be located closer to the end of wellbore 114 than the second component.

Figure 2:
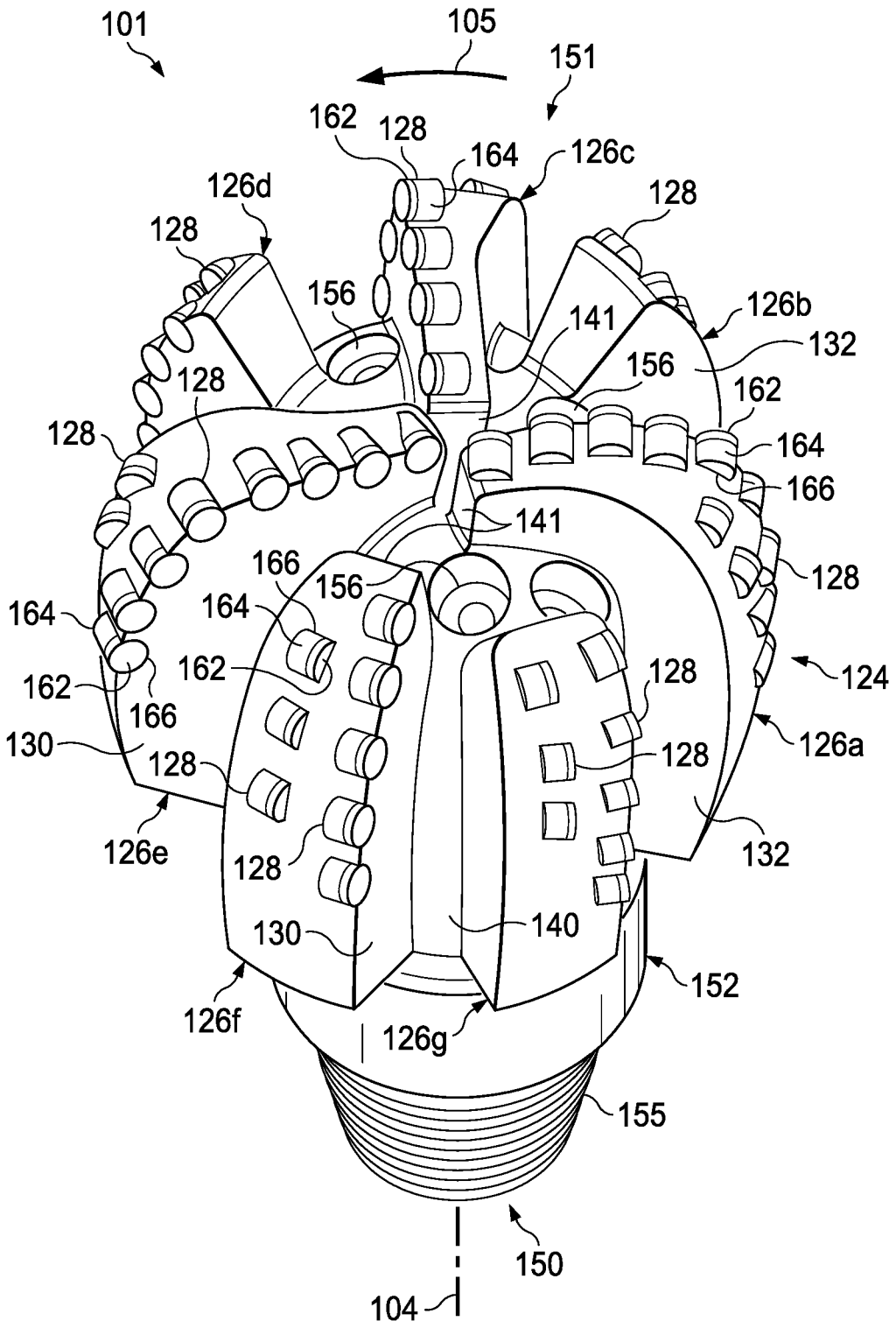
FIG. 2 is an isometric view of a rotary drill bit oriented upwardly in a manner often used to design fixed cutter drill bits.

FIG. 2 illustrates an isometric view of a rotary drill bit oriented upwardly in a manner often used to design fixed cutter drill bits. Drill bit 101 may be any of various types of rotary drill bits, including fixed cutter drill bits, polycrystalline diamond compact (PDC) drill bits, drag bits, matrix drill bits, and/or steel body drill bits operable to form a wellbore (e.g., wellbore 114 as illustrated in FIG. 1) extending through one or more downhole formations. Drill bit 101 may be designed and formed in accordance with teachings of the present disclosure and may have many different designs, configurations, and/or dimensions according to the particular application of drill bit 101.

Drill bit 101 may include one or more blades 126 (e.g., blades 126*a*-126*g*) that may be disposed outwardly from exterior portions of bit body 124 of drill bit 101. Blades 126 may be any suitable type of projections extending outwardly from bit body 124. For example, a portion of blade 126 may be directly or indirectly coupled to an exterior portion of bit body 124, while another portion of blade 126 may be projected away from the exterior portion of bit body 124. Blades 126 formed in accordance with teachings of the present disclosure may have a wide variety of configurations including, but not limited to, substantially arched, generally helical, spiraling, tapered, converging, diverging, symmetrical, and/or asymmetrical. In some embodiments, one or more blades 126 may have a substantially arched configuration extending from proximate rotational axis 104 of drill bit 101. The arched configuration may be defined in part by a generally concave, recessed shaped portion extending from proximate bit rotational axis 104. The arched configuration may also be defined in part by a generally convex, outwardly curved portion disposed between the concave, recessed portion and exterior portions of each blade which correspond generally with the outside diameter of the rotary drill bit.

Each of blades 126 may include a first end disposed proximate or toward bit rotational axis 104 and a second end disposed proximate or toward exterior portions of drill bit 101 (e.g., disposed generally away from bit rotational axis 104 and toward uphole portions of drill bit 101). Blades 126*a*-126*g* may include primary blades disposed about the bit rotational axis. For example, blades 126*a*, 126*c*, and 126*e* may be primary blades or major blades because respective first ends 141 of each of blades 126*a*, 126*c*, and 126*e* may be disposed closely adjacent to bit rotational axis 104 of drill bit 101. Blades 126*a*-126*g* may also include at least one secondary blade disposed between the primary blades. In the illustrated embodiment, blades 126*b*, 126*d*, 126*f*, and 126*g* on drill bit 101 may be secondary blades or minor blades because respective first ends 141 may be disposed on downhole end 151 of drill bit 101 a distance from associated bit rotational axis 104. The number and location of primary blades and secondary blades may vary such that drill bit 101 includes more or less primary and secondary blades. Blades 126 may be disposed symmetrically or asymmetrically with regard to each other and bit rotational axis 104 where the location of blades 126 may be based on the downhole drilling conditions of the drilling environment. Blades 126 and drill bit 101 may rotate about rotational axis 104 in a direction defined by directional arrow 105.

Each of blades 126 may have respective leading or front surfaces 130 in the direction of rotation of drill bit 101 and trailing or back surfaces 132 located opposite of leading surface 130 away from the direction of rotation of drill bit 101. Blades 126 may be positioned along bit body 124 such that they have a spiral configuration relative to bit rotational axis 104. Blades 126 may also be positioned along bit body 124 in a generally parallel configuration with respect to each other and bit rotational axis 104. Although FIG. 2 illustrates seven blades 126, drill bits designed and manufactured in accordance with the teachings of the present disclosure may have fewer than seven blades or more than seven blades.

Blades 126 may include one or more cutting elements 128 disposed outwardly from exterior portions of each blade 126. For example, a portion of cutting element 128 may be directly or indirectly coupled to an exterior portion of blade 126 while another portion of cutting element 128 may be projected away from the exterior portion of blade 126. By way of example and not limitation, cutting elements 128 may be various types of cutters, compacts, buttons, inserts, and gage cutters satisfactory for use with a wide variety of drill bits 101. Although FIG. 2 illustrates two rows of cutting elements 128 on blades 126, drill bits designed and manufactured in accordance with the teachings of the present disclosure may have one row of cutting elements or more than two rows of cutting elements.

Cutting elements 128 may be any suitable device configured to cut into a formation, including but not limited to, primary cutting elements, back-up cutting elements, secondary cutting elements or any combination thereof. Cutting elements 128 may include respective substrates 164 with a layer of hard cutting material (e.g., cutting table 162) disposed on one end of each respective substrate 164. The hard layer of cutting elements 128 may provide a cutting surface that may engage adjacent portions of a downhole formation to form wellbore 114 as illustrated in FIG. 1. The contact of the cutting surface with the formation may form a cutting zone (not expressly illustrated) associated with each of cutting elements 128. For example, the cutting zone may be formed by the two-dimensional area, on the face of a cutting element, that comes into contact with the formation, and cuts into the formation. The edge of the portion of cutting element 128 located within the cutting zone may be referred to as the cutting edge of a cutting element 128.

Each substrate 164 of cutting elements 128 may have various configurations and may be formed from tungsten carbide or other suitable materials associated with forming cutting elements for rotary drill bits. Tungsten carbides may include, but are not limited to, monotungsten carbide (WC), ditungsten carbide ($W_2C$), macrocrystalline tungsten carbide and cemented or sintered tungsten carbide. Substrates may also be formed using other hard materials, which may include various metal alloys and cements such as metal borides, metal carbides, metal oxides and metal nitrides. For some applications, the hard cutting layer may be formed from substantially the same materials as the substrate. In other applications, the hard cutting layer may be formed from different materials than the substrate. Examples of materials used to form hard cutting layers may include polycrystalline diamond materials, including synthetic polycrystalline diamonds. Blades 126 may include recesses or bit pockets 166 that may be configured to receive cutting elements 128. For example, bit pockets 166 may be concave cutouts on blades 126.

Blades 126 may also include one or more depth of cut controllers (DOCCs) (not expressly shown) that may be configured according to their shape and/or relative positioning on drill bit 101 to control the depth of cut of cutting elements 128. A DOCC may include an impact arrestor, a back-up or second layer cutting element and/or a Modified Diamond Reinforcement (MDR). Exterior portions of blades 126, cutting elements 128 and DOCCs (not expressly shown) may form portions of the bit face. Cutting elements 128 and DOCCs may extend beyond a drilling profile of the drill bit. The distance by which the cutting elements and DOCCs extend from the drilling profile may be referred to as the exposure of the element or DOCC. As described in further detail below with reference to FIGS. 3-9, drill bit 101 may include primary DOCCs and associated secondary DOCCs. Primary DOCCs may contact a subterranean formation to prevent cutting elements 128 from over engaging with the formation. Secondary DOCCs associated with primary DOCCs may be configured with a lesser exposure than the exposure of primary DOCC and/or having a lesser height relative to the height of primary DOCC as long as the force acting on primary DOCC remains below a threshold. When a force acting on a primary DOCC exceeds the threshold, the primary DOCC may increase the height of an associated secondary DOCC relative to the height of the primary DOCC. As discussed above, increasing the height of a secondary DOCC may increase the total surface area of the DOCC assembly that engages with the subterranean formation at a given depth of cut and may provide a greater amount of depth of cut control for corresponding cutting elements.

Blades 126 may further include one or more gage pads (not expressly shown) disposed on blades 126. A gage pad may be a gage, gage segment, or gage portion disposed on exterior portion of blade 126. Gage pads may contact adjacent portions of a wellbore (e.g., wellbore 114 as illustrated in FIG. 1) formed by drill bit 101. Exterior portions of blades 126 and/or associated gage pads may be disposed at various angles (e.g., positive, negative, and/or parallel) relative to adjacent portions of generally vertical wellbore 114*a*. A gage pad may include one or more layers of hardfacing material.

Uphole end 150 of drill bit 101 may include shank 152 with drill pipe threads 155 formed thereon. Threads 155 may be used to releasably engage drill bit 101 with BHA 120 whereby drill bit 101 may be rotated relative to bit rotational axis 104. Downhole end 151 of drill bit 101 may include a plurality of blades 126*a*-126*g* with respective junk slots or fluid flow paths 140 disposed therebetween. Additionally, drilling fluids may be communicated to one or more nozzles 156.

A drill bit operation may be expressed in terms of depth of cut per revolution as a function of drilling depth. Depth of cut per revolution, or depth of cut, may be determined by rate of penetration (ROP) and RPM. ROP may represent the amount of formation that is removed as drill bit 101 rotates and may be expressed in units of ft/hr. Further, RPM may represent the rotational speed of drill bit 101. Actual depth of cut (Δ) may represent a measure of the depth that cutting elements cut into the formation during a rotation of drill bit 101. Thus, actual depth of cut may be expressed as a function of actual ROP and RPM using the following equation:

$$\Delta = ROP/(5*RPM)$$

Actual depth of cut may have a unit of in/rev.

The ROP of drill bit 101 is often a function of both WOB and RPM. Referring to FIG. 1, drill string 103 may apply weight on drill bit 101 and may also rotate drill bit 101 about rotational axis 104 to form a wellbore 114 (e.g., wellbore 114*a* or wellbore 114*b*). For some applications a downhole motor (not expressly shown) may be provided as part of BHA 120 to also rotate drill bit 101.

Figure 3:
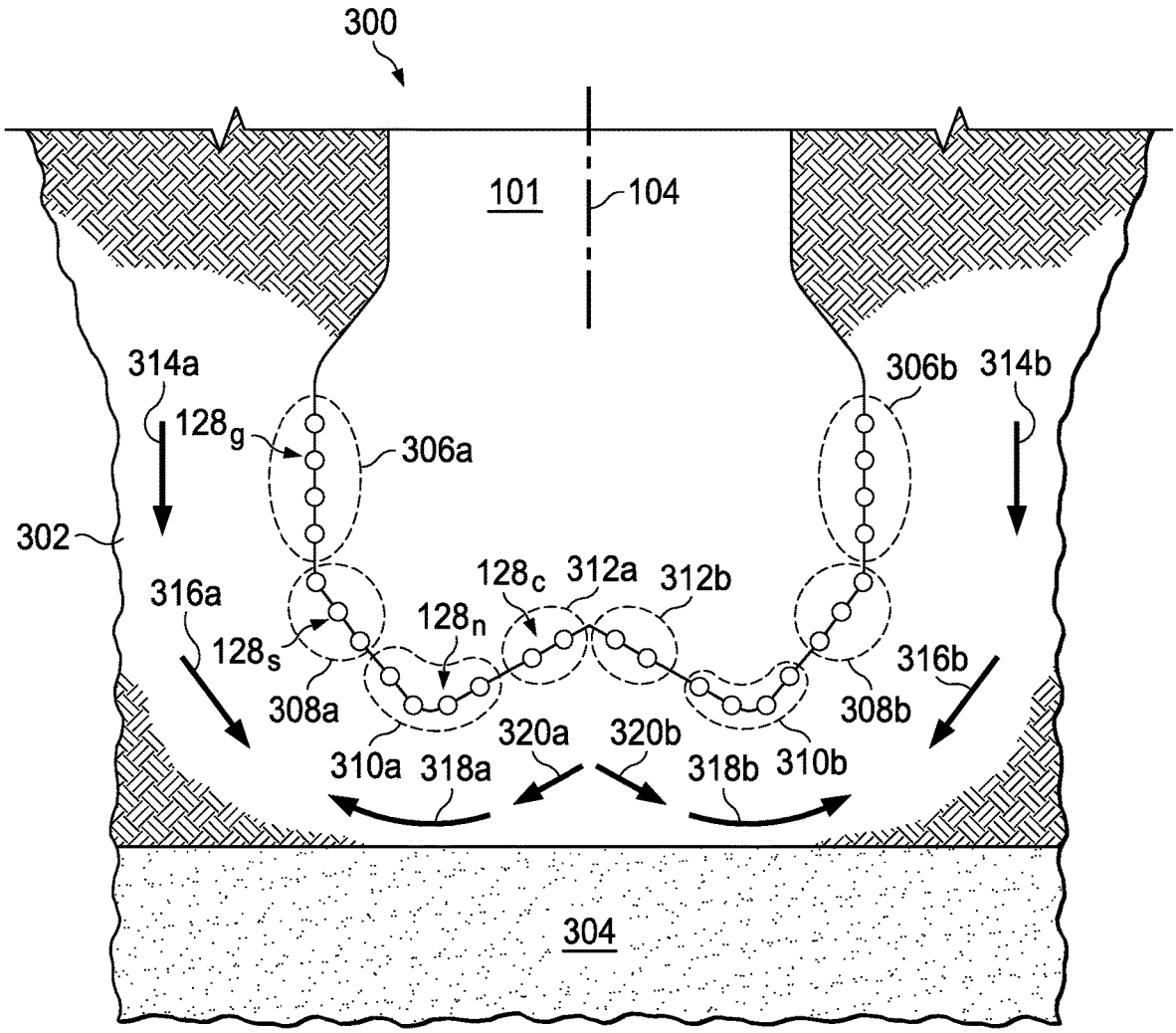
FIG. 3 is a bit face profile of a drill bit configured to form a wellbore through a first formation layer into a second formation layer.

FIG. 3 illustrates bit face profile 300 of drill bit 101 configured to form a wellbore through first formation layer 302 into second formation layer 304. Exterior portions of blades (not expressly shown), cutting elements 128 and DOCCs (not expressly shown) may be projected rotationally onto a radial plane to form bit face profile 300. In the illustrated embodiment, formation layer 302 may be softer or less hard when compared to downhole formation layer 304. As shown in FIG. 3, exterior portions of drill bit 101 that contact adjacent portions of a downhole formation may be referred to as a bit face. Bit face profile 300 of drill bit 101 may include various zones or segments. Bit face profile 300 may be substantially symmetric about bit rotational axis 104 due to the rotational projection of bit face profile 300, such that the zones or segments on one side of rotational axis 104 may be substantially similar to the zones or segments on the opposite side of rotational axis 104.

For example, bit face profile 300 may include gage zone 306*a* located opposite gage zone 306*b*, shoulder zone 308*a* located opposite shoulder zone 308*b*, nose zone 310*a* located opposite nose zone 310*b*, and cone zone 312*a* located opposite cone zone 312*b*. Cutting elements 128 included in each zone may be referred to as cutting elements of that zone. For example, cutting elements 128*g* included in gage zones 306 may be referred to as gage cutting elements, cutting elements 128*s* included in shoulder zones 308 may be referred to as shoulder cutting elements, cutting elements 128*n* included in nose zones 310 may be referred to as nose cutting elements, and cutting elements 128*c* included in cone zones 312 may be referred to as cone cutting elements.

Cone zones 312 may be generally concave and may be formed on exterior portions of each blade (e.g., blades 126 as illustrated in FIG. 1) of drill bit 101, adjacent to and extending out from bit rotational axis 104. Nose zones 310 may be generally convex and may be formed on exterior portions of each blade of drill bit 101, adjacent to and extending from each cone zone 312. Shoulder zones 308 may be formed on exterior portions of each blade 126 extending from respective nose zones 310 and may terminate proximate to a respective gage zone 306.

According to the present disclosure, a DOCC assembly (not expressly shown) may be included on drill bit 101 to provide an improved depth of cut control for cutting elements 128. Although not illustrated in FIG. 3, a DOCC assembly may be located behind cutting elements 128 in the direction of rotation. The design of each DOCC assembly may be based at least partially on the location of each cutting element 128 with respect to a particular zone of the bit face profile 300 (e.g., gage zone 306, shoulder zone 308, nose zone 310 or cone zone 312). For example, in gage zones 306*a* and 306*b*, frictional forces act on cutting elements 128*g* and any corresponding DOCC assemblies in the direction of arrows 314*a* and 314*b*. Additionally, in shoulder zones 308*a* and 308*b*, frictional forces act on cutting elements 128*s* and any corresponding DOCC assemblies in the direction of arrows 316*a* and 316*b*. In nose zones 310*a* and 310*b*, frictional forces act on cutting elements 128*n* and any corresponding DOCC assemblies in the direction of arrows 318*a* and 318*b*. In cone zones 312*a* and 312*b*, frictional forces act on cutting elements 128*c* and DOCC assemblies in the direction of arrows 320*a* and 320*b*. Thus, each DOCC assembly located in these various zones (e.g., gage zone 306, shoulder zone 308, nose zone 310 or cone zone 312) may be designed such that frictional forces above a threshold cause primary DOCC to displace secondary DOCC and cause the height of secondary DOCC to increase relative to the height of primary DOCC as described in more detail below with respect to FIGS. 4A-6B. Further, as mentioned above, the various zones of bit face profile 300 may be based on the profile of blades 126 of drill bit 101.

Figure 4A:
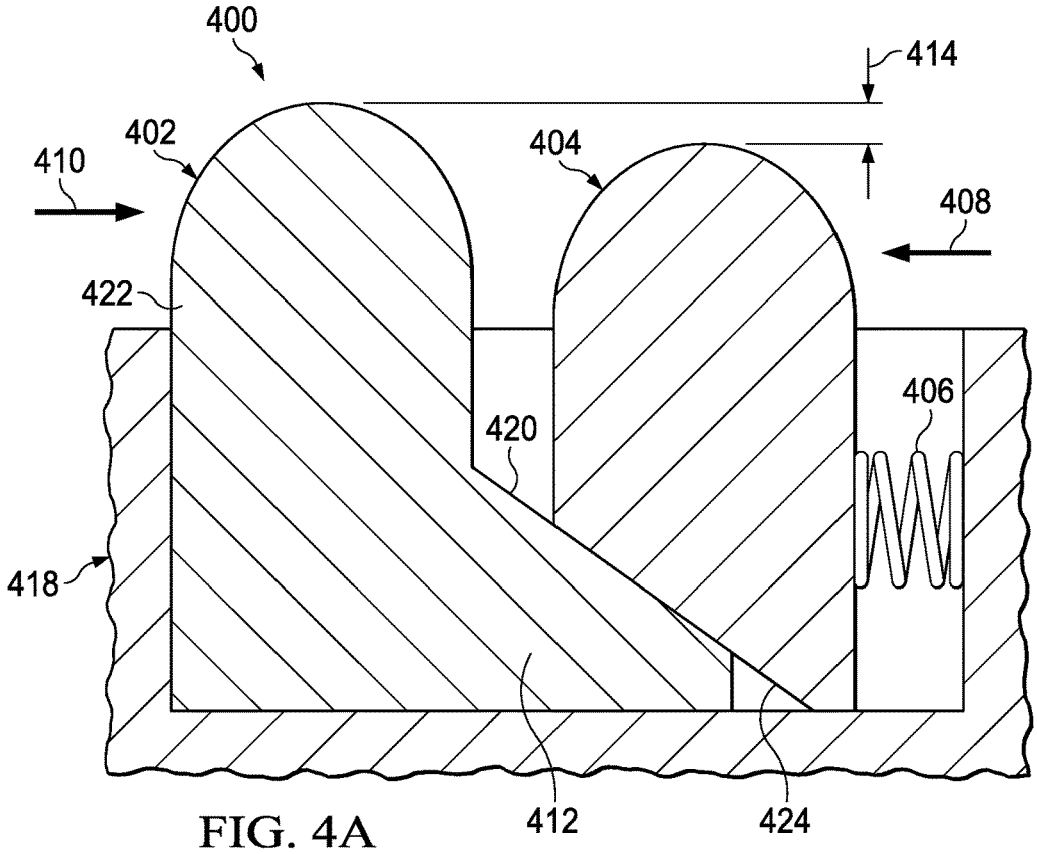
FIG. 4A is a cross-sectional view of an exemplary depth of cut controller (DOCC) assembly including a primary DOCC, and an associated secondary DOCC having a lesser height relative to a height of the primary DOCC.

FIG. 4A illustrates a cross-sectional view of DOCC assembly 400 including primary DOCC 402, and associated secondary DOCC 404 having a lesser height than a height of primary DOCC 402. DOCC assembly 400, primary DOCC 402, and secondary DOCC 404 may operate to reduce the likelihood that a downhole drilling tool over-engages with a formation. Over-engagement may include circumstances where cutting elements on a downhole drill tool penetrate too deep into a formation for a drill system to operate efficiently. When cutting elements over-engage with a formation, a frictional force acting on the downhole drilling tool may increase, causing undesirable drill string vibrations or slip-stick behavior. DOCC assembly 400, primary DOCC 402, and secondary DOCC 404 may mitigate these issues by controlling the depth that cutting elements of the downhole drilling tool may cut into or engage with a formation. For example, primary DOCC 402 and secondary DOCC 404 may include a surface to engage with a formation to take a load off of or away from a cutting element. Surfaces of primary DOCC 402 and secondary DOCC 404 may be designed to contact a formation without exceeding the compressive strength of the formation, so that the DOCC contacts the formation without penetrating into the formation.

During a drilling operation, a force may act on primary DOCC 402 and/or secondary DOCC 404 as a result of the DOCCs interacting with the formation being drilled. When the force acting on primary DOCC 402 and/or secondary DOCC 404 is less than the compressive strength of a formation, the DOCCs may operate to prevent a downhole drilling tool from penetrating further into the formation. If the force acting on primary DOCC 402 and/or secondary DOCC 404 is greater than the compressive strength of a formation, a DOCC may crush the formation, and consequently may not prevent the downhole drilling tool from penetrating further into the formation.

The force acting on primary DOCC 402 and secondary DOCC 404 may be proportional to the area of contact between each of the DOCCs and a formation in that a larger surface bears a larger portion of the load than a smaller surface. Primary DOCC 402 and secondary DOCC 404 may be designed with increased surface area such that each DOCC may exert a reduced amount of pressure on a formation and the drill bit may be unable to penetrate the formation as deeply, i.e., the depth of cut may be limited. Therefore, designing primary DOCC 402 and/or secondary DOCC 404 with increased surface area may improve the ability of each of the DOCCs to prevent over-engagement. Although primary DOCC 402 and secondary DOCC 404 may also generate friction between a downhole drilling tool and a formation, this additional friction may mitigate vibrations of the downhole drilling tool and allow for faster drilling operations.

DOCC assembly 400 may include primary DOCC 402 and secondary DOCC 404. DOCC assembly 400 may also include housing 418 to retain primary DOCC 402 and secondary DOCC 404, and other components of DOCC assembly 400 described below. Housing 418 may have various configurations and may be formed from tungsten carbide, various metal alloys and cements such as metal borides, metal carbides, metal oxides and metal nitrides, or other suitable materials for forming housings for rotary drill bits. Housing 418 may be attached to a downhole drilling tool by welding, brazing, or any other suitable attachment method. Although DOCC assembly 400 is illustrated with housing 418, a housing may be omitted from the DOCC assembly, and other components of DOCC assembly may be attached to a downhole drilling tool. For example, other components of DOCC assembly may be attached to a cavity within a downhole drilling tool itself rather than being attached to a housing attached to the drilling tool.

Primary DOCC 402 may control a depth of cut as described above during any drilling operation. During normal drilling operations where frictional force 410 remains below a force threshold, secondary DOCC 404 may have a height that is less than a height of primary DOCC 402, as shown in FIG. 4A. Specifically, secondary DOCC 404 is under-exposed with respect to primary DOCC 402 by distance 414. A secondary DOCC that is under-exposed relative to a primary DOCC extends a smaller distance from the surface of a downhole drilling tool than the primary DOCC. Because secondary DOCC 404 has a height that is less than the height of primary DOCC 402, primary DOCC 402 may contact a formation while secondary DOCC 404 may not contact the formation. Therefore, during normal drilling operations, primary DOCC 402, alone, may operate to limit the depth of cut of a downhole drilling tool while secondary DOCC 404 does not contact the formation and, thus, does not limit the depth of cut.

As shown in FIG. 4A, primary DOCC 402 may be movably secured to housing 418 and may be movable in response to contact by a formation (not expressly shown) when drilling. Primary DOCC 402 may be movable in the direction of frictional force 410 and in the opposite direction. However, primary DOCC 402 is constrained such that it may not move in either of the directions that are perpendicular to the direction of frictional force 410. For example, primary DOCC 402 may not move away from the bit body (i.e., in the vertical direction as depicted in FIG. 4A). For further example, primary DOCC 402 may not move in a sidewise direction. Primary DOCC 402 is also constrained such that it may not rotate about any axis. In some instances, a track (not expressly shown) may movably secure primary DOCC 402 to the drill bit and/or the housing 418. The track may be oriented such that primary DOCC 402 moves along the track at a constant height relative to the drill bit and/or the housing. In other instances, other components may be used to constrain primary DOCC 402 from moving in various directions.

Elastic member 406 may maintain primary DOCC 402 in a substantially stationary position within DOCC assembly 400, and with respect to the downhole drilling tool, during normal drilling operations where frictional force 410 remains below a force threshold. Elastic member 406 may be implemented with any suitable elastic member that provides a desired spring constant or Young's modulus in order to provide a desired biasing force. Elastic member 406 may be implemented, for example, by a coil spring, a Belleville spring, a wave spring, hydraulic elements, pneumatic elements, or a low modulus material or a material with high elasticity that deforms under load (e.g., rubber, other elastomers, or other elastically deformable materials). Suitable materials include materials that exhibit linear elastic deformation in response to forces in the range that includes at least 80% of the friction force range expected to be encountered by DOCC assembly 400 while drilling a wellbore. These materials may each have a Young's modulus sufficient to allow movement of secondary DOCC 404 such that the height of secondary DOCC 404 may change relative to the height of primary DOCC 402. In particular, the materials may have a Young's modulus of 500 GPa or less, 400 GPa or less, 300 GPa or less, 200 GPa or less, or 100 GPa or less. In some examples, the materials may exhibit non-linear elastic deformation in response to a friction force that exceeds at least 80% of the friction force range expected to be encountered by DOCC assembly 400 while drilling a wellbore.

As shown in FIG. 4A, secondary DOCC 404 may be movably secured to housing 418. Secondary DOCC may be movable in the direction of frictional force 410 and biasing force 408, and in the opposite direction. Secondary DOCC 404 may also be moveable in the direction parallel to an inclined surface 420 on a ramp 412 and a bottom surface 424 of secondary DOCC 404. However, secondary DOCC 404 is constrained such that it may not move in the various other directions. For example, while secondary DOCC 404 may move in the direction parallel to inclined surface 420, secondary DOCC 404 may not move in the direction perpendicular to this surface. Secondary DOCC 404 may be constrained such that bottom surface 424 does not lose contact with inclined surface 420. For further example, secondary DOCC 404 may not move in a sidewise direction. Secondary DOCC 404 is also constrained such that it may not rotate about any axis. As shown in FIG. 4A, elastic member 406 is coupled to secondary DOCC 404.

Figure 4B:
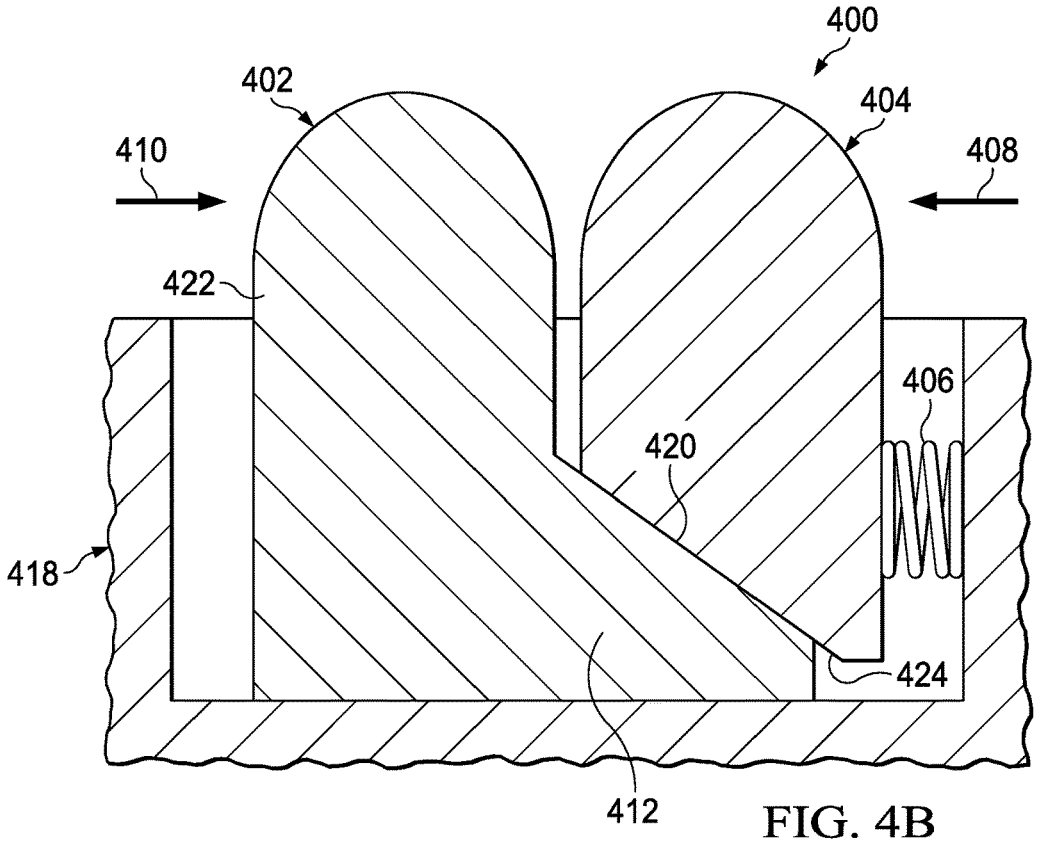
FIG. 4B is a cross-sectional view of the DOCC assembly of FIG. 4A with the associated secondary DOCC having a greater height relative to the height of the primary DOCC.

Elastic member 406 may generate and apply biasing force 408 to secondary DOCC 404, which may, in turn, transfer biasing force 408 to primary DOCC 402. Elastic member 406 is coupled to secondary DOCC 404 and to either housing 418, if present, or to a cavity within a blade of a drilling tool. The biasing force 408 generated by elastic member 406 may oppose movement of primary DOCC 402. Secondary DOCC 404 is also coupled to primary DOCC 402 such that movement of primary DOCC 402 changes a height of secondary DOCC relative to a height of primary DOCC. As shown in FIGS. 4A and 4B, secondary DOCC 404 is coupled to primary DOCC 402 by way of bottom surface 424 in sliding contact with inclined surface 420 of ramp 412. Ramp 412 may be integral with primary DOCC, as shown in FIGS. 4A and 4B. Bottom surface 424 of secondary DOCC 404 is in contact with inclined surface 420 of ramp 412 such that secondary DOCC 404 transfers forces to primary DOCC 402. As elastic member 406 generates biasing force 408 and applies the force to secondary DOCC 404, secondary DOCC 404 is forced in the direction of biasing force 408 and toward primary DOCC 402. Secondary DOCC 404 transfers biasing force 408 to primary DOCC 402 through the interaction of bottom surface 424 with inclined surface 420. Inclined surface 420 and bottom surface 424 may be designed such that frictional forces between the surfaces, in addition to biasing force 408, prevent secondary DOCC 404 from moving along inclined surface 420 where frictional force 410 remains below a force threshold.

During drilling operations, the interaction between the rotating drill bit and the geological formation being drilled through causes frictional force 410 to act on primary DOCC 402. Frictional force 410 acting on primary DOCC 402 may operate to cause primary DOCC 402 to move in a direction opposite biasing force 408 generated by elastic member 406, which is applied to secondary DOCC 404 and transferred to primary DOCC 402 by secondary DOCC 404. Frictional force 410 may vary depending on the period of the drilling operation and frictional force 410 may be larger when drilling through formations with a relatively high compressive strength or when transitioning between portions of formations with different compressive strengths. Frictional force 410 may also be larger when a drilling tool is being operated at relatively high RPM or WOB settings. During periods of drilling operations where frictional force 410 remains below a force threshold, elastic member 406 may operate to maintain primary DOCC 402 in a substantially stationary position within DOCC assembly 400, and with respect to the downhole drilling tool.

FIG. 4B illustrates a cross-sectional view of DOCC assembly 400 with primary DOCC 402 and secondary DOCC 404 having a greater height relative to a height of primary DOCC 402. As described above with reference to FIG. 4A, primary DOCC 402 may increase the height of secondary DOCC 404 under certain drilling conditions, e.g., when frictional force 410 approaches a force threshold. When frictional force 410 reaches the force threshold, primary DOCC 402 and secondary DOCC 404 may have substantially the same height and exposure such that distance 414 is substantially equal to zero. During certain periods of drilling operations, the interaction between the rotating drill bit and the geological formation being drilled through causes frictional force 410 to act on primary DOCC 402. During periods of drilling operations where frictional force 410 increases and approaches a force threshold such that it begins to overcome biasing force 408, primary DOCC 402 may begin to move in the direction of frictional force 410 and elastic member 406 and inclined surface 420 may operate to physically displace secondary DOCC 404 and increase the height of secondary DOCC 404 relative to the height of primary DOCC 402. For example, frictional force 410 may cause primary DOCC 402 to displace and slide laterally towards secondary DOCC 404 and elastic member 406. Primary DOCC 402 may include ramp 412 that is integral with and extends from body 422 of primary DOCC 402. Ramp 412 may be composed of the same or a different material than body 422.

Primary DOCC 402 may be movable laterally toward secondary DOCC 404 such that ramp 412 moves laterally beneath secondary DOCC 404 and causes secondary DOCC to slide up ramp 412. Ramp 412 may include inclined surface 420 that operates to physically displace secondary DOCC 404 as primary DOCC 402 moves laterally towards secondary DOCC 404 and elastic member 406. For example, as shown in FIGS. 4A and 4B, inclined surface 420 extends at a slope from body 422 of primary DOCC 402 down and toward secondary DOCC 404. As also shown, inclined surface 420 may be formed on ramp 412 such that, as frictional force 410 acts on primary DOCC 402, inclined surface 420 of ramp 412 engages secondary DOCC 404 along bottom surface 424 to displace secondary DOCC 404 and increase the height and exposure of secondary DOCC 404 relative to primary DOCC 402. As discussed above with reference to FIG. 4A, secondary DOCC 404 is under-exposed relative to primary DOCC 402 when it has a lesser height relative to the height of primary DOCC 402. As secondary DOCC 404 is displaced by ramp 412 and inclined surface 420, secondary DOCC 404 extends farther from the surface of the drilling tool. When the height of secondary DOCC 404 is increased to be substantially the same as the height of primary DOCC 402, secondary DOCC 404 may have substantially the same exposure as primary DOCC 402 such that secondary DOCC 404 engages with the formation. When secondary DOCC 404 engages the formation, the height and exposure of secondary DOCC 404 may fluctuate, such that secondary DOCC 404 may be temporarily under-exposed or over-exposed relative to primary DOCC 402, but secondary DOCC 404 remains engaged with the formation.

Where secondary DOCC 404 engages the formation, DOCC assembly 400 provides a larger total surface area that engages the formation and allows for greater depth of cut control than where primary DOCC 402 engages the formation alone.

During periods of drilling operation where frictional force 410 decreases below a force threshold such that it no longer overcomes biasing force 408, elastic member 406 may operate to decrease the height and exposure of secondary DOCC 404 relative to the height and exposure of primary DOCC 402. For example, biasing force 408 may cause secondary DOCC 404 to slide laterally down inclined surface 420. As biasing force 408 displaces secondary DOCC 404, secondary DOCC 404 causes primary DOCC 402 to slide laterally away from secondary DOCC 404 and elastic member 406. During periods of drilling operations where frictional force 410 remains below a force threshold, elastic member 406 may operate to maintain primary DOCC 402 and secondary DOCC 404 in a substantially stationary position within DOCC assembly 400, as described above with reference to FIG. 4A.

Figure 5A:
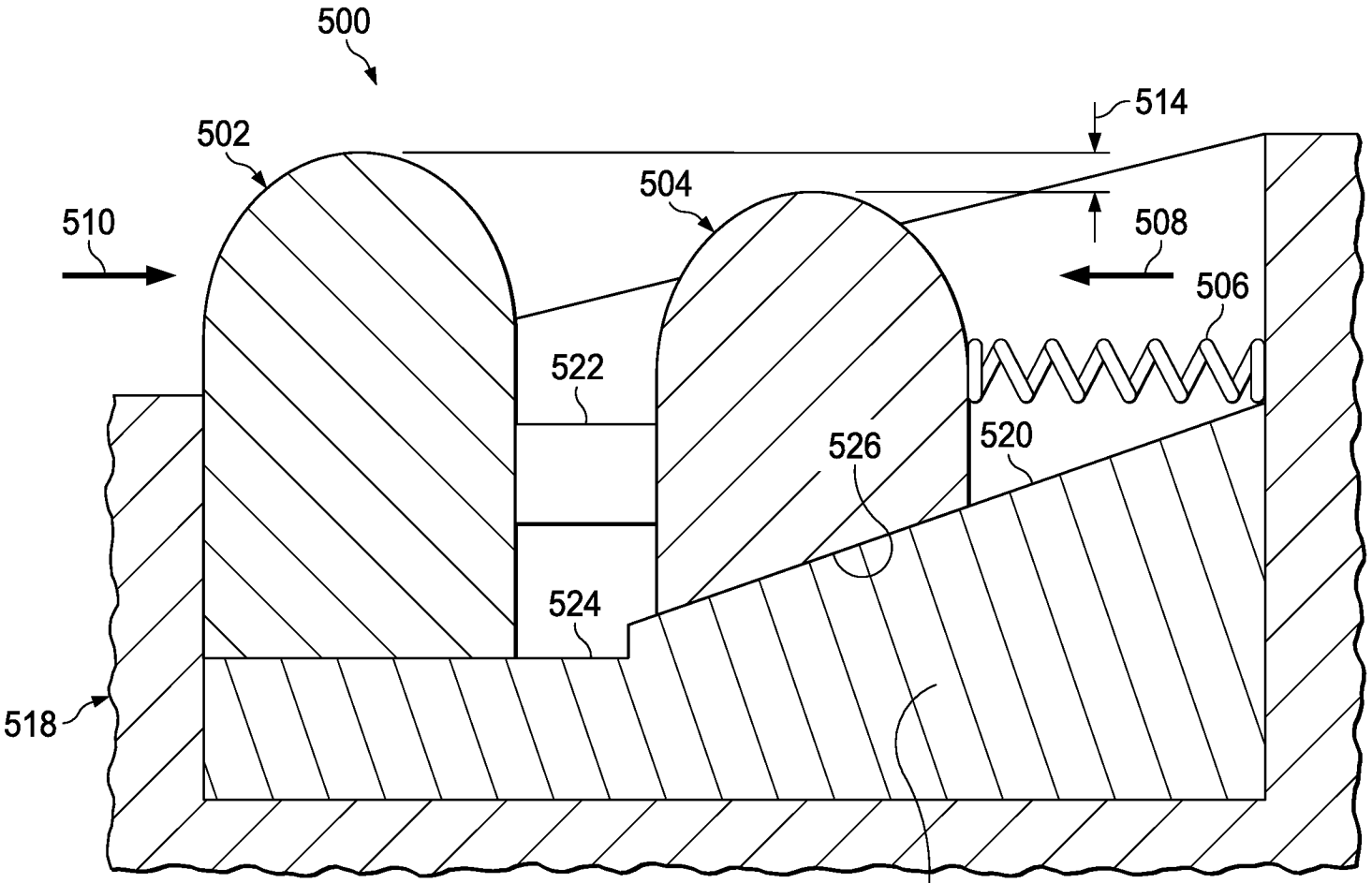
FIG. 5A is a cross-sectional view of another exemplary DOCC assembly including a primary DOCC, and an associated secondary DOCC having a lesser height relative to the height of the primary DOCC.

FIG. 5A illustrates a cross-sectional view of another exemplary DOCC assembly 500 including primary DOCC 502, and associated secondary DOCC 504 having a lesser height than a height of primary DOCC 502. DOCC assembly 500 may include housing 518. Housing 518 may be similar to housing 418, discussed above with reference to FIGS. 4A and 4B. DOCC assembly 500 may further include primary DOCC 502 and secondary DOCC 504. Primary DOCC 502 may control a depth of cut in a manner similar to primary DOCC 402, discussed above with reference to FIGS. 4A and 4B. During normal drilling operations where frictional force 510 remains below a force threshold, secondary DOCC 504 may have a lesser height relative to a height of primary DOCC 502 (i.e., under-exposed relative to primary DOCC 502). Specifically, secondary DOCC 504 is under-exposed with respect to primary DOCC 502 by distance 514.

As shown in FIG. 5A, primary DOCC 502 may be movably secured to housing 518 and may be movable in response to contact by a formation (not expressly shown) when drilling. Primary DOCC 502 may be movable in the direction of frictional force 510 and in the opposite direction. However, primary DOCC 502 may be constrained such that it may not move in either of the directions that are perpendicular to the direction of frictional force 510. For example, primary DOCC 502 may not move away from the bit body (i.e., in the vertical direction as depicted in FIG. 5A). For further example, primary DOCC 502 may not move in a sidewise direction. Primary DOCC 502 is also constrained such that it may not rotate about any axis. As discussed above in reference to FIGS. 4A and 4B, a track (not expressly shown) or other components may be used to constrain primary DOCC 502 from moving in various directions.

As shown in FIG. 5A, secondary DOCC 504 may be movably secured to housing 518. Secondary DOCC 504 may be movable in the direction of frictional force 510 and biasing force 508, and in the opposite direction. Secondary DOCC 504 may also be moveable in the direction parallel to an inclined surface 520 on a ramp 512 and a bottom surface 526 of secondary DOCC 504. However, secondary DOCC 504 is constrained such that it may not move in the various other directions. For example, while secondary DOCC 504 may move in the direction parallel to inclined surface 520, secondary DOCC 504 may not move in the direction perpendicular to this surface. Secondary DOCC 504 may be constrained such that bottom surface 526 does not lose contact with inclined surface 520. For further example, secondary DOCC 504 may not move in a sidewise direction. Secondary DOCC 504 is also constrained such that it may not rotate about any axis. As shown in FIG. 5A, elastic member 506 is coupled to secondary DOCC 504.

DOCC assembly 500 may include elastic member 506 coupled to secondary DOCC 504 and to either housing 518, if present, or to a cavity within a drilling tool. Elastic member 506 may be similar to elastic member 406, discussed above with reference to FIGS. 4A and 4B. Elastic member 506 may generate and apply biasing force 508 to secondary DOCC 504 and secondary DOCC 504 may, in turn, transfer biasing force 508 to primary DOCC 502. Biasing force 508 generated by elastic member 506 may oppose movement of primary DOCC 502. Secondary DOCC 504 may also be coupled to primary DOCC 502 such that movement of primary DOCC 502 changes a height of secondary DOCC 504 relative to a height of primary DOCC 502. As illustrated in FIG. 5A, secondary DOCC 504 is coupled to primary DOCC 502 via spacing member 522. For example, spacing member 522 may be flexibly coupled to primary DOCC 502 and secondary DOCC 504 to maintain a substantially fixed distance between primary DOCC 502 and secondary DOCC 504. Accordingly, elastic member 506 may apply biasing force 508 to secondary DOCC 504, and secondary DOCC 504 may transfer biasing force 508 to primary DOCC 502 through spacing member 522.

During drilling operations, the interaction between the rotating drill bit and the geological formation being drilled through causes frictional force 510 to act on primary DOCC 502. Frictional force 510 acting on primary DOCC 502 may operate to cause primary DOCC 502 to move in a direction opposite biasing force 508 generated by elastic member 506. Frictional force 510 may vary depending on the period of the drilling operation and frictional force 510 may be larger when drilling through formations with a relatively high compressive strength or when transitioning between portions of formations with different compressive strengths. Frictional force 510 may also be larger when a drilling tool is being operated at relatively high RPM or WOB settings. During periods of drilling operations where frictional force 510 remains below a force threshold, elastic member 506 and biasing force 508 may operate to maintain primary DOCC 502 and secondary DOCC 504 in a substantially stationary position within DOCC assembly 500 and with respect to the downhole drilling tool.

DOCC assembly 500 may include ramp 512 and flat surface 524 adjacent to ramp 512. Ramp 512 may be composed of the same or a different material as primary DOCC 502. Ramp 512 may include inclined surface 520. Primary DOCC 502 may be in sliding contact with and move along flat surface 524. Secondary DOCC 504 may include bottom surface 526 in sliding contact with inclined surface 520. Ramp 512 and flat surface 524 may be formed integrally with housing 518 or may be attached to a cavity in a drilling tool if housing 518 is not present.

Figure 5B:
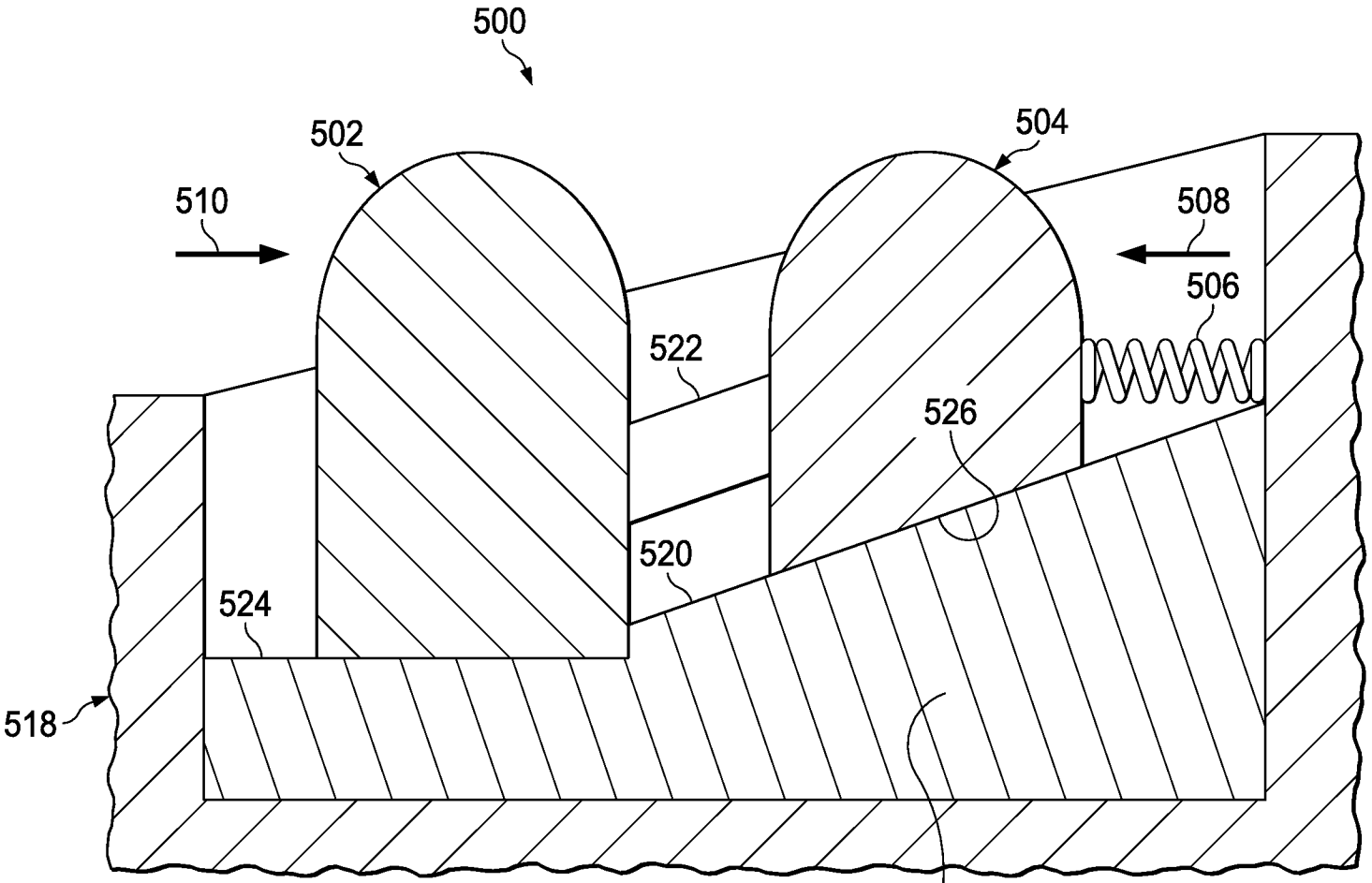
FIG. 5B is a cross-sectional view of the DOCC assembly of FIG. 5A with the associated secondary DOCC having a greater height relative to the height of the primary DOCC.

FIG. 5B illustrates a cross-sectional view of DOCC assembly 500 of FIG. 5A with secondary DOCC 504 having a greater height relative to a height of primary DOCC 502. Primary DOCC 502 may be configured to increase the height of secondary DOCC 504 under certain drilling conditions. During certain periods of drilling operations, the interaction between the rotating drill bit and the geological formation being drilled through causes frictional force 510 to act on primary DOCC 502. As described above, frictional force 510 will vary depending on the period of the drilling operation. During periods of drilling operations where frictional force 510 increases such that it approaches a force threshold and begins to overcome biasing force 508, primary DOCC 502 may begin to move in the direction of frictional force 510 and primary DOCC 502, spacing member 522, and ramp 512 may operate to physically displace secondary DOCC 504 and increase the height of secondary DOCC 504 relative to the height of primary DOCC 502. For example, frictional force 510 may cause primary DOCC 502 to displace and slide laterally towards elastic member 506. As primary DOCC 502 displaces, secondary DOCC 504 will also displace given that primary DOCC 502 and secondary DOCC 504 are coupled together by spacing member 522. Primary DOCC 502 and spacing member 522 may cause secondary DOCC 504 to slide up ramp 512 to increase the height of secondary DOCC 504 relative to the height of primary DOCC 502. Elastic member 506 may begin to compress as the height of secondary DOCC 504 increases as secondary DOCC 504 slides up ramp 512. When frictional force 510 reaches the force threshold, primary DOCC 502 and secondary DOCC 504 may have substantially the same height and exposure such that distance 514 is substantially equal to zero.

Flat surface 524 may operate to maintain primary DOCC 502 at a fixed exposure or a constant height relative to the housing and/or drill bit as primary DOCC 502 moves laterally towards elastic member 506. For example, flat surface 524 may include a substantially flat portion of housing 518 or a cavity in a drilling tool that allows primary DOCC 502 to move laterally toward elastic member 506. Inclined surface 520 of ramp 512 may operate to physically displace secondary DOCC 504 and increase the height of secondary DOCC 504 as primary DOCC 502 moves laterally towards elastic member 506. For example, inclined surface 520 may extend at a slope from surface 524 up and toward secondary DOCC 504 and elastic member 506. As also shown, surface 520 may be formed on ramp 512 such that secondary DOCC 504 extends further from the surface of the drill bit as frictional force 510 acts on primary DOCC 502 to move primary DOCC 502 along surface 524 toward elastic member 506. As discussed above with reference to FIG. 5A, secondary DOCC 504 is under-exposed relative to primary DOCC 502 when secondary DOCC 504 has a lesser height relative to the height of primary DOCC 502. As secondary DOCC 504 is displaced by inclined surface 520 of ramp 512, the height and exposure of secondary DOCC 504 relative to the height of primary DOCC 502 increases. When the height of secondary DOCC 504 is increased to be substantially the same as the height of primary DOCC 502, secondary DOCC 504 may have substantially the same exposure as primary DOCC 502 such that secondary DOCC 504 engages with the formation. Where secondary DOCC 504 engages the formation, the height and exposure of secondary DOCC 504 may fluctuate, such that secondary DOCC 504 may be temporarily under-exposed or over-exposed relative to primary DOCC 502, but secondary DOCC 504 remains engaged with the formation. Where secondary DOCC 504 engages the formation, DOCC assembly 500 provides a larger total surface area that engages the formation and allows for greater depth of cut control than where primary DOCC 502 engages the formation alone.

During periods of drilling operation where frictional force 510 decreases such that it no longer overcomes biasing force 508, elastic member 506 may operate to decrease the height and exposure of secondary DOCC 504 relative to the height and exposure of primary DOCC 502. For example, biasing force 508 may cause secondary DOCC 504 to slide laterally down inclined surface 520 of ramp 512. As biasing force 508 displaces secondary DOCC 504, secondary DOCC 504, by way of spacing member 522, causes primary DOCC 502 to slide laterally away from elastic member 506. During periods of drilling operations where frictional force 510 remains below the force threshold, elastic member 506 may operate to maintain primary DOCC 502 and secondary DOCC 504 in a substantially stationary position within DOCC assembly 500 and with respect to the downhole drilling tool, as described above with reference to FIG. 5A.

Figure 6A:
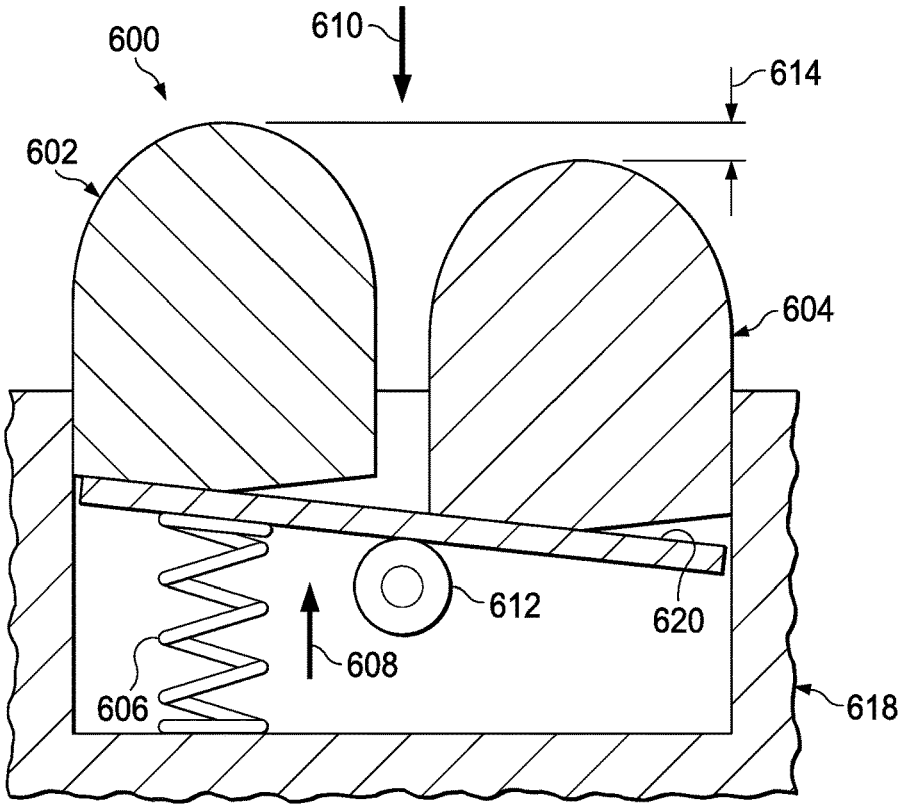
FIG. 6A is a cross-sectional view of a further exemplary DOCC assembly including a primary DOCC and an associated secondary DOCC having a lesser height relative to the height of the primary DOCC.

FIG. 6A illustrates a cross-sectional view of a further exemplary DOCC assembly 600 including primary DOCC 602, and associated secondary DOCC 604 having a lesser height relative to a height of primary DOCC 602. DOCC assembly 600 may utilize an alternative mechanism to change the height of secondary DOCC 604 relative to the height of primary DOCC 602. DOCC assembly 600 may include housing 618. Housing 618 may be similar to housing 418, discussed above with reference to FIGS. 4A and 4B. DOCC assembly 600 may further include primary DOCC 602 and secondary DOCC 604. Primary DOCC 602 may control a depth of cut in a manner similar to primary DOCC 402, discussed above with reference to FIGS. 4A and 4B. DOCC assembly 600 may include a toggling pivot structure to allow the height of secondary DOCC 604 to change relative to the height of primary DOCC 602. For example, DOCC assembly 600 may include toggle 612 and inclined surface 620. Toggle 612 may be pivotably coupled to a pivot point and the housing 618 and/or the drill bit. During normal drilling operations where frictional force 610 remains below a force threshold, secondary DOCC 604 may have a height that is less than the height of primary DOCC 602 (i.e., under-exposed relative to primary DOCC 602).

Secondary DOCC 604 may be coupled to primary DOCC 602 such that movement of primary DOCC 602 changes the height of secondary DOCC 604 relative to the height of primary DOCC. Primary DOCC 602 and secondary DOCC 604 may be coupled to toggle 612 such that the pivot point of toggle 612 is located between primary DOCC 602 and secondary DOCC 604. Primary DOCC 602 may be movable such that primary DOCC causes toggle 612 to pivot about the pivot point and changes the height of secondary DOCC 604 relative to the height of primary DOCC 602.

As shown in FIG. 6A, primary DOCC 602 is movable in the direction of frictional force 610 and in the opposite direction. However, primary DOCC 602 is constrained such that it may not move in either of the directions that are perpendicular to the direction of frictional force 610. For example, primary DOCC 602 may not move laterally (i.e., toward secondary DOCC 604) or in a sidewise direction. Primary DOCC 602 is also constrained such that it may not rotate about any axis (i.e., primary DOCC 602 remains vertical, as shown in FIG. 6A, as toggle 612 rotates).

As shown in FIG. 6A, secondary DOCC 604 is movable in the direction of frictional force 610 and biasing force 608, and in the opposite direction. However, secondary DOCC 604 is constrained such that it may not move in either of the directions that are perpendicular to the direction of frictional force 610. For example, secondary DOCC 604 may not move laterally (i.e., toward primary DOCC 602) or in a sidewise direction. Secondary DOCC 604 is also constrained such that it may not rotate about any axis (i.e., secondary DOCC 604 remains vertical, as shown in FIG. 6A, as toggle 612 rotates).

DOCC assembly 600 may include elastic member 606 coupled to toggle 612 and to either housing 618, if present, or to a cavity within a drilling tool. Elastic member 606 may be similar to elastic member 406, discussed above with reference to FIGS. 4A and 4B. Elastic member 606 may generate and apply biasing force 608 to toggle 612. As illustrated in FIG. 6A, primary DOCC 602 and secondary DOCC 604 may be coupled to toggle 612 at inclined surface 620. Elastic member 606 may be coupled to toggle 612 at a point between the pivot point and where primary DOCC 602 is coupled to toggle 612. Accordingly, elastic member 606 may apply biasing force 608 to toggle 612 to maintain secondary DOCC 604 such that the height of secondary DOCC 604 is less than the height of primary DOCC 602.

During drilling operations, the interaction between the rotating drill bit and the geological formation being drilled through causes frictional force 610 to act on primary DOCC 602. Frictional force 610 acting on primary DOCC 602 may operate to move primary DOCC 602 in a direction toward elastic member 606 and opposite biasing force 608 generated by elastic member 606. Biasing force 608 may oppose movement of primary DOCC 602. Frictional force 610 may vary depending on the period of the drilling operation and frictional force 610 may be larger when drilling through formations with a relatively high compressive strength or when transitioning between portions of formations with different compressive strengths. Frictional force 610 may also be larger when a drilling tool is being operated at relatively high RPM or WOB settings. During periods of drilling operations where frictional force 610 remains below a force threshold, biasing force 608 may maintain toggle 612 in a position such that secondary DOCC 604 has a height that is less than the height of primary DOCC 602 and secondary DOCC 604 is underexposed relative to primary DOCC 602 by distance 614.

Figure 6B:
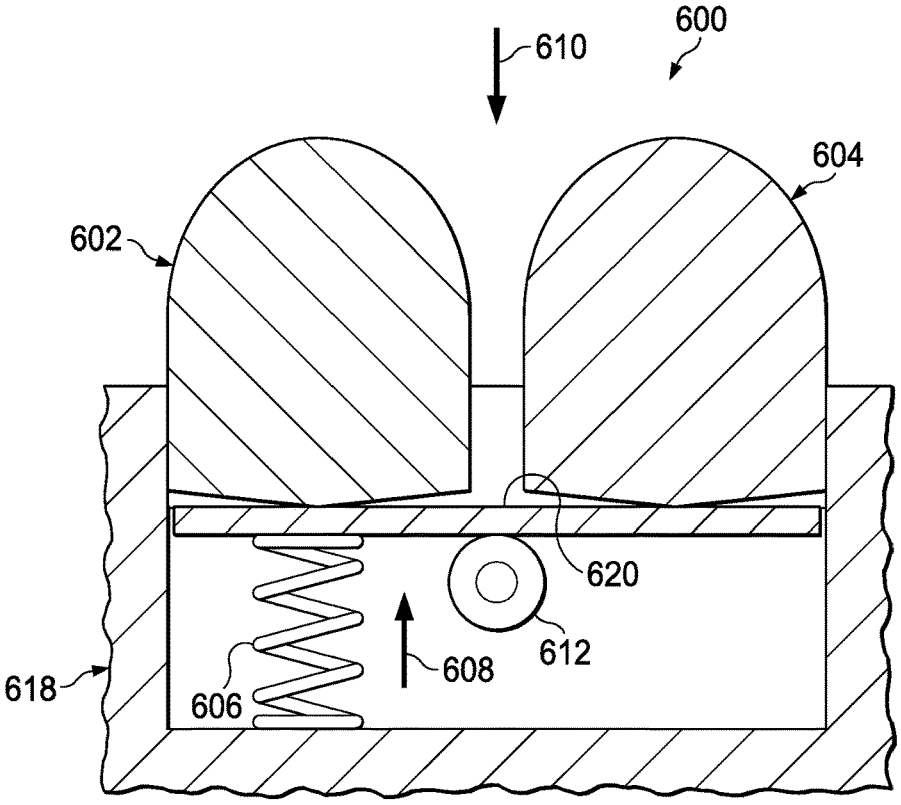
FIG. 6B is a cross-sectional view of the DOCC assembly of FIG. 6A with the associated secondary DOCC having a greater height relative to the height of the primary DOCC.

FIG. 6B illustrates a cross-sectional view of the DOCC assembly 600 of FIG. 6A with secondary DOCC 604 having a greater height relative to the height of primary DOCC 604. Primary DOCC 602 may be configured to pivot toggle 612 and increase the height of secondary DOCC 604 under certain drilling conditions. During periods of drilling operations where frictional force 610 increases such that it approaches a force threshold, primary DOCC 602 may begin to move in the direction of frictional force 610 and toggle 612 may operate to increase the height of secondary DOCC 604 relative to the height of primary DOCC 602 as toggle 612 rotates. For example, frictional force 610 may cause primary DOCC 602 to displace in the direction of elastic member 606 as toggle 612 rotates counter-clockwise about the pivot point. As primary DOCC 602 displaces, secondary DOCC 604 will displace in the opposite direction given that primary DOCC 602 and secondary DOCC 604 are coupled to toggle 612 on opposite sides of the pivot point. Elastic member 606 may begin to compress as the height of secondary DOCC 604 increases with respect to the height of primary DOCC, toggle 612 pivots, primary DOCC 602 moves down, and secondary DOCC 604 simultaneously moves up. When frictional force 610 reaches the force threshold, primary DOCC 602 and secondary DOCC 604 may have substantially the same height and exposure such that distance 614 is substantially equal to zero.

Toggle 612 may operate to simultaneously, and inversely, adjust the height and exposure of primary DOCC 602 and secondary DOCC 604 as toggle 612 pivots. Toggle 612 may operate to physically displace secondary DOCC 604 as primary DOCC 602 moves down in the direction of elastic member 606. As discussed above with reference to FIG. 6A, secondary DOCC 604 is under-exposed relative to primary DOCC 602 when secondary DOCC 604 has a lesser height than the height of primary DOCC 602. As secondary DOCC 604 is displaced by toggle 612 and inclined surface 620, the height of secondary DOCC 604 increases as secondary DOCC 604 extends farther from the surface of the drilling tool. When the height of secondary DOCC 604 increases, secondary DOCC 604 may have substantially the same exposure as primary DOCC 602 such that secondary DOCC 604 engages with the formation. When secondary DOCC 604 engages with the formation, the height and exposure of secondary DOCC 604 may fluctuate, such that secondary DOCC 604 may be temporarily under-exposed or over-exposed relative to primary DOCC 602, but secondary DOCC 604 remains engaged with the formation. Where secondary DOCC 604 engages the formation, DOCC assembly 600 provides a larger total surface area that engages the formation and allows for greater depth of cut control than where primary DOCC 602 engages the formation alone.

Primary DOCC 602 and secondary DOCC 604 may be located along inclined surface 620 at various positions with respect to the pivot point of toggle 612. For example, primary DOCC 602 and secondary DOCC 604 may be positioned the same distance away from the pivot point of toggle 612. In this configuration, as primary DOCC 602 displaces and toggle 612 pivots, secondary DOCC 604 will displace an amount approximately equal in magnitude to the displacement of primary DOCC 602, but in the opposite direction. As another example, primary DOCC 602 may be positioned at a distance from the pivot point that is greater than the distance at which secondary DOCC 604 is positioned relative to the pivot point. In this configuration, as primary DOCC 602 displaces and toggle 612 pivots, secondary DOCC 604 will displace an amount smaller in magnitude than the displacement of primary DOCC 602, and in the opposite direction. As a further example, primary DOCC 602 may be positioned at a distance from the pivot point that is less than the distance at which secondary DOCC 604 is positioned relative to the pivot point. In this configuration, as primary DOCC 602 displaces and toggle 612 pivots, secondary DOCC 604 will displace an amount greater in magnitude than the displacement of primary DOCC 602, and in the opposite direction. Thus, DOCC assembly 600 may be configured such that toggle 612 pivoting causes an increase or decrease in the height and exposure of secondary DOCC 604 that is less than, more than, or the same in magnitude as the corresponding decrease or increase in the height and exposure of primary DOCC 602. Primary DOCC 602 and secondary DOCC 604 may also be positioned away from the pivot point such that, when the height of primary DOCC 602 changes, the height of secondary DOCC 604 changes relative to a height of a cutting element on the drill bit.

During periods of drilling operation where frictional force 610 decreases such that it falls below the force threshold, elastic member 606 may operate to decrease the height of secondary DOCC 604 relative to the height of primary DOCC 602. For example, biasing force 608 may cause toggle 612 to rotate counter-clockwise about the pivot point. As toggle 612 rotates, elastic member 606 may begin to decompress as secondary DOCC 604 moves down and the height of secondary DOCC 604 decreases relative to the height of primary DOCC 602 and primary DOCC 602 moves up away from elastic member 606. During periods of drilling operations where frictional force 610 remains below the force threshold, elastic member 606 may operate to maintain primary DOCC 602 and secondary DOCC 604 in a substantially stationary position within DOCC assembly 600 and with respect to the downhole drilling tool, as described above with reference to FIG. 6A.

FIGS. 7A-7F illustrate the face of a drill bit including DOCC assembly 708 located thereon. As explained below with reference to FIGS. 7A-7F, the orientation of DOCC assembly 708 may depend on, among other factors, a location of DOCC assembly 708 on drill bit 701.

FIGS. 7A-7F illustrate the face of a drill bit including DOCC assembly 708 located on drill bit 701. Drill bit 701 may include blades 726*a-c*, and outer cutting elements 728*a-c* and inner cutting elements 729*a-c* disposed on blades 726*a-c*. In the illustrated embodiment, DOCC assembly 708 is located on a blade 726*a* and configured to control the depth of cut of all cutting elements 729 located within swath 731 of drill bit 701. To provide a frame of reference, FIGS. 7A-7F include z-axis 753 that represents the rotational axis of drill bit 701. A coordinate or position corresponding to the z-axis may be referred to as an axial coordinate or axial position. FIGS. 7A-7F also include x-axis 751 and y-axis 752 that represent the radial axes of drill bit 701. A coordinate or position corresponding to the x-axis or y-axis may be referred to as a radial coordinate or position. Additionally, a location along the bit face of drill bit 701 shown in FIGS. 7A-7F may be described by x and y coordinates of the xy-plane illustrated by x-axis 751 and y-axis 752. The xy-plane may be substantially perpendicular to z-axis 753 such that the xy-plane of FIGS. 7A-7F may be substantially perpendicular to the rotational axis of drill bit 701. Furthermore, as discussed above with reference to FIG. 3, a bit face of drill bit 701 may include various zones, such as nose zone 730, cone zone 731, shoulder zone 732, or gage zone 733.

DOCC assembly 708 may include features similar to the DOCC assemblies discussed above with reference to FIGS. 4A-6B. For example, DOCC assembly 708 may include primary DOCC 702, secondary DOCC 704, and elastic member 706. The orientation of DOCC assembly 708 may depend on the location of DOCC assembly 708 on drill bit 701. As described above with reference to FIGS. 4A-6B, DOCC assembly 708 may be configured such that a height of a secondary DOCC 704 increases relative to a height of a primary DOCC 702 when a force acting on a primary DOCC 702 approaches a force threshold. During drilling operations, the interaction between the rotating drill bit and the geological formation being drilled through causes a frictional force to act on components of DOCC assembly 708. The direction of the frictional force acting on primary DOCC 702 may depend on the location of DOCC assembly 708 on drill bit 701. For example, in nose zone 730 or cone zone 731, a frictional force may include a component directed away from bit rotational axis 753. By contrast, in shoulder zone 732 or gage zone 733, a frictional force may include a component directed toward bit rotational axis 753.

Figure 7A:
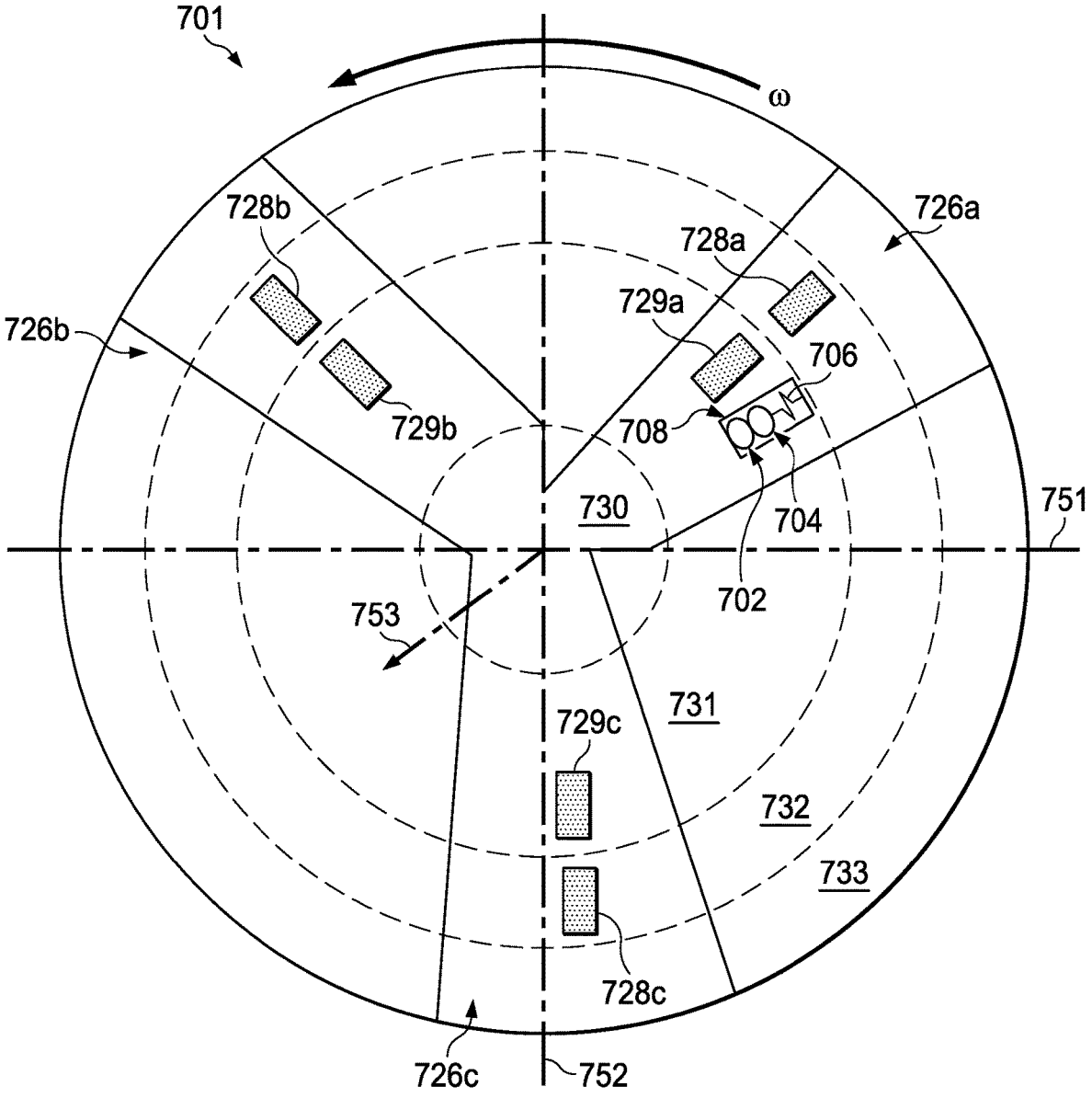
FIGS. 7A-7F are faces of a drill bit including a DOCC assembly located thereon.
Figure 7B:
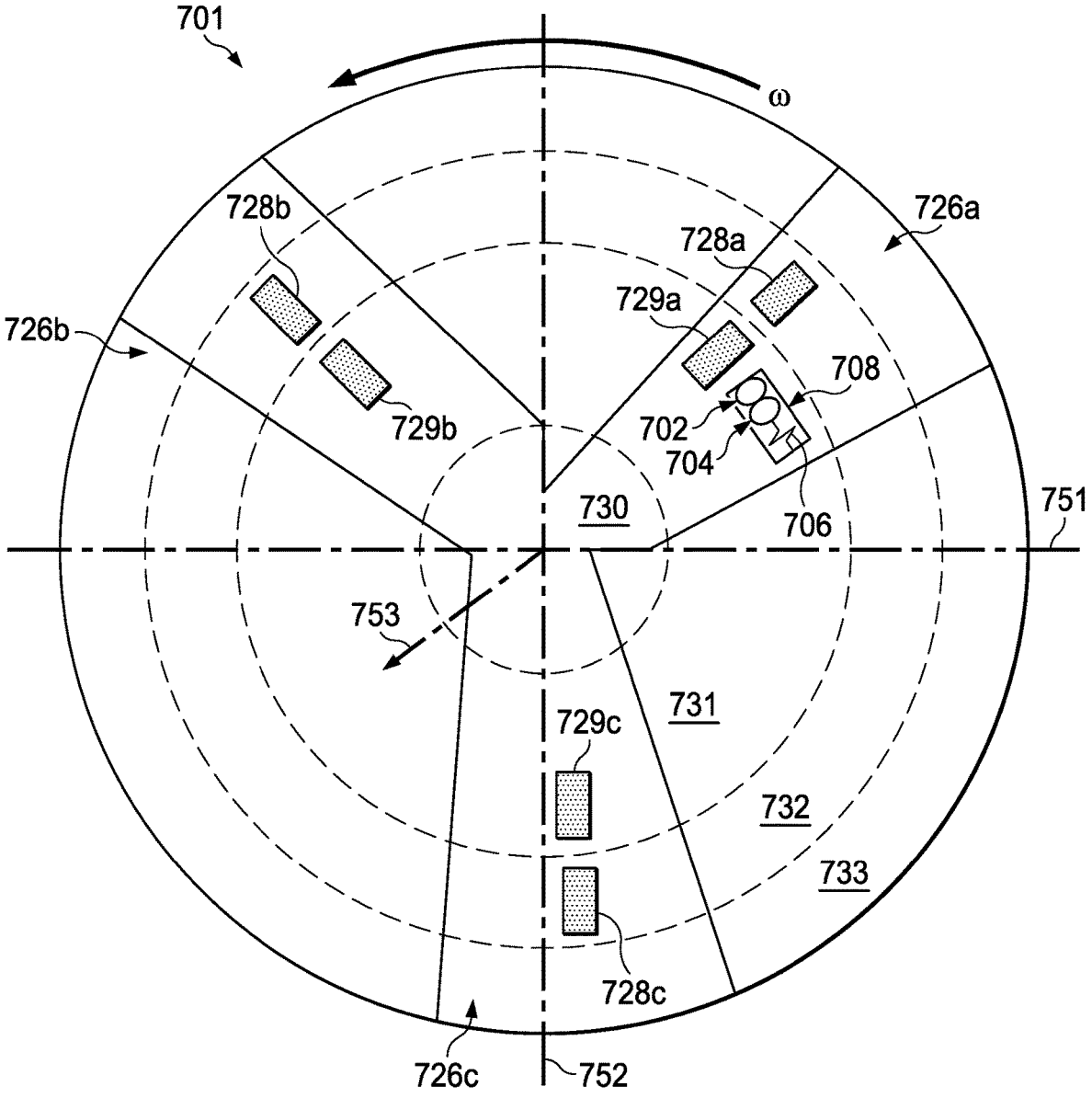
Figure 7C:
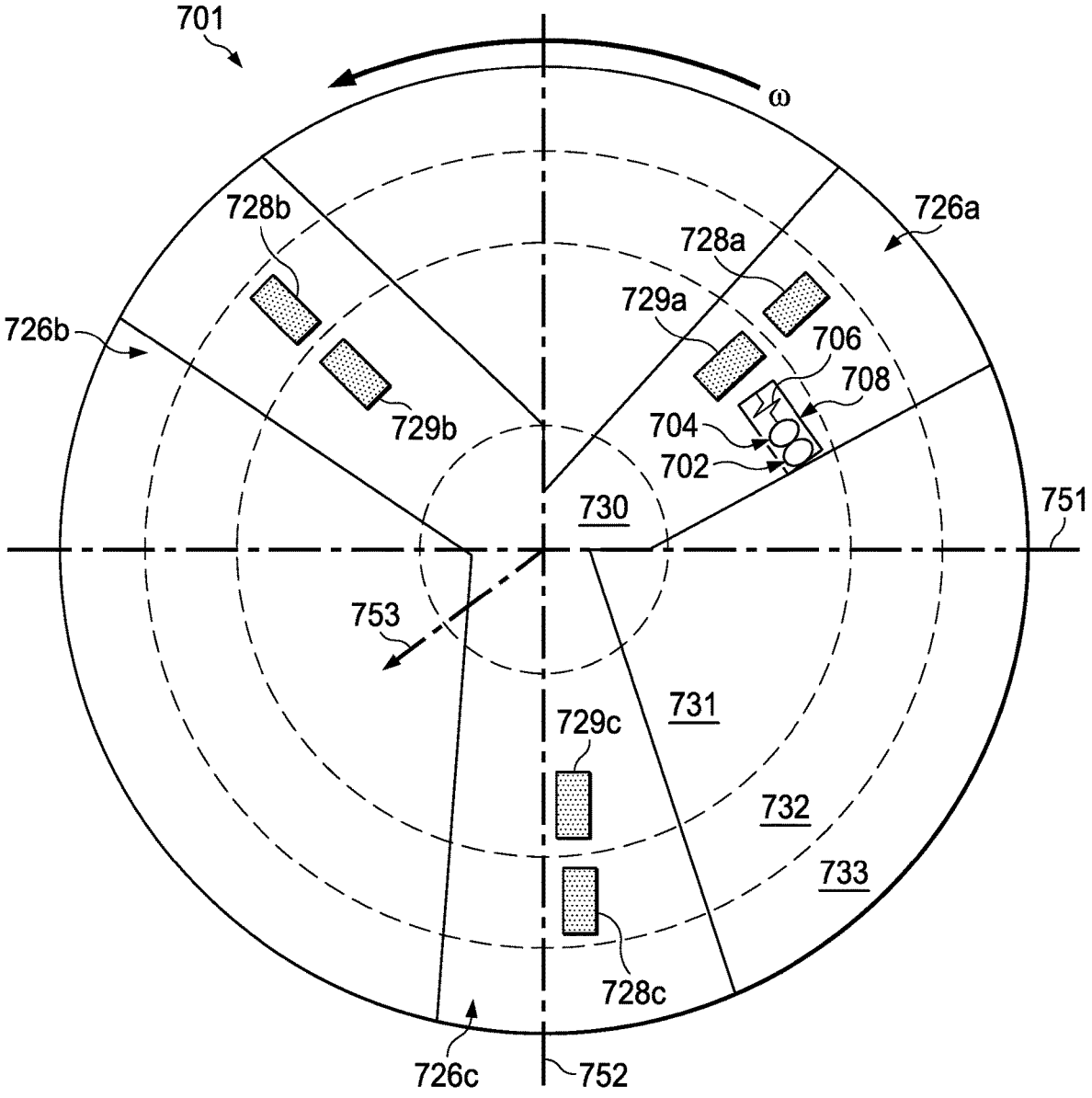

FIGS. 7A-7C illustrate orientations of DOCC assembly 708 in a nose zone of a drill bit. Although not expressly illustrated in FIGS. 7A-7C, the following description is also applicable to DOCC assemblies in a cone zone of a drill bit. As illustrated in FIG. 7A, DOCC assembly 708 may be located in nose zone 730. Because a frictional force acting on a nose zone or cone zone of a drill bit points away from bit rotational axis 753, DOCC assembly 708 may be oriented so that primary DOCC 702 is closer to the bit rotational axis 753 than secondary DOCC 704 and secondary DOCC 704 is located closer to the outer edge of the face of drill bit 701.

DOCC assembly 708 may be rotated between approximately 0 degrees and 90 degrees in either the counterclockwise or clockwise direction from the location illustrated in FIG. 7A. For example, FIG. 7B illustrates the face of a drill bit including DOCC assembly 708 located on drill bit 701. In FIG. 7B the orientation of DOCC assembly 708 is rotated approximately 90 degrees clockwise from the orientation of DOCC assembly 708 illustrated in FIG. 7A. As shown in FIG. 7B, secondary DOCC 704 is track set with primary DOCC 702 and trails primary DOCC 702 in the direction of rotation of the drill bit. Likewise, FIG. 7C illustrates the face of a drill bit including DOCC assembly 708 located on drill bit 701. In FIG. 7C the orientation of DOCC assembly 708 is rotated approximately 90 degrees counterclockwise from the orientation of DOCC assembly 708 illustrated in FIG. 7A. As shown in FIG. 7C, primary DOCC 702 is track set with secondary DOCC 704 and trails secondary DOCC 704 in the direction of rotation of the drill bit.

Figure 7D:
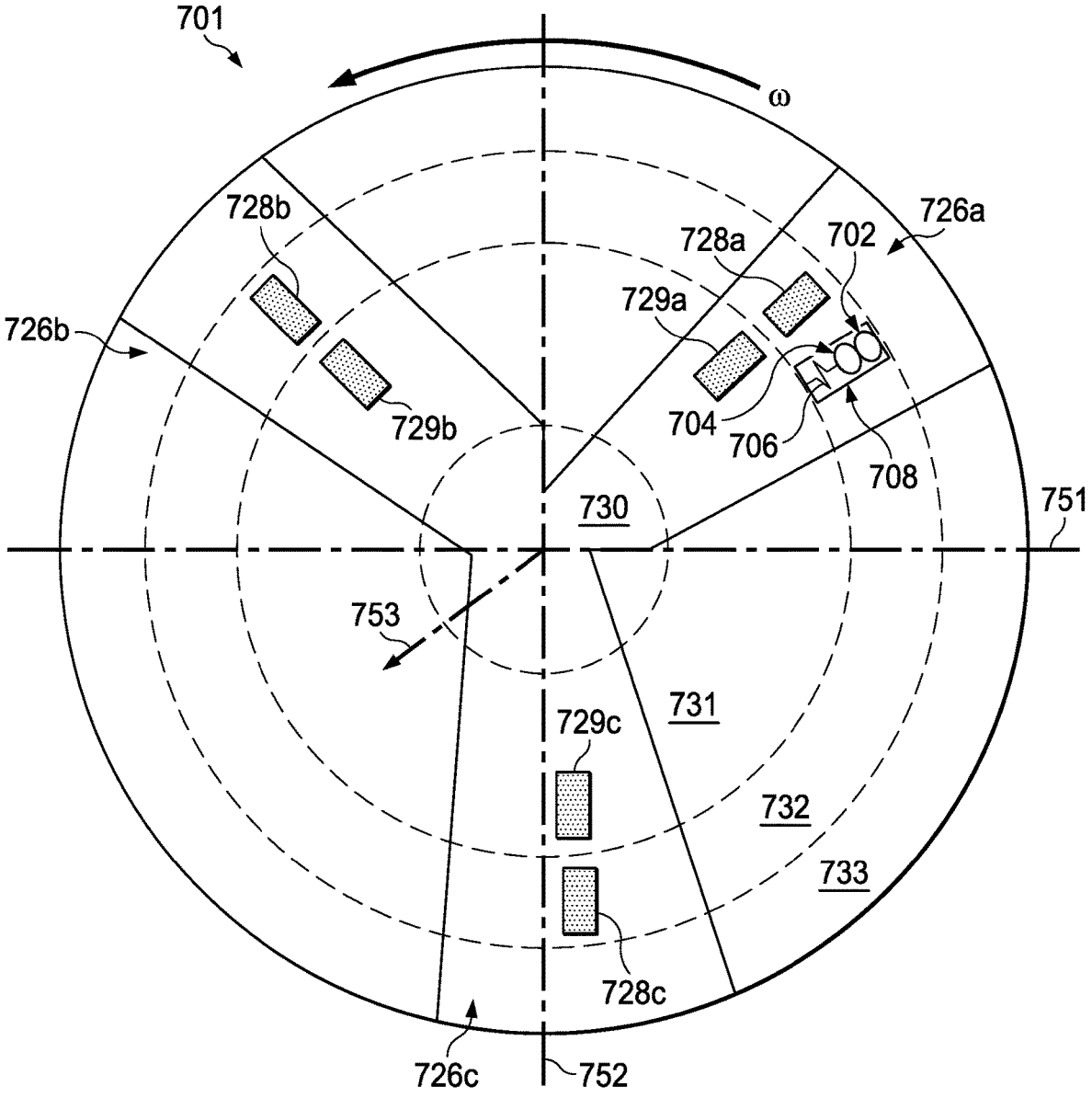
Figure 7E:
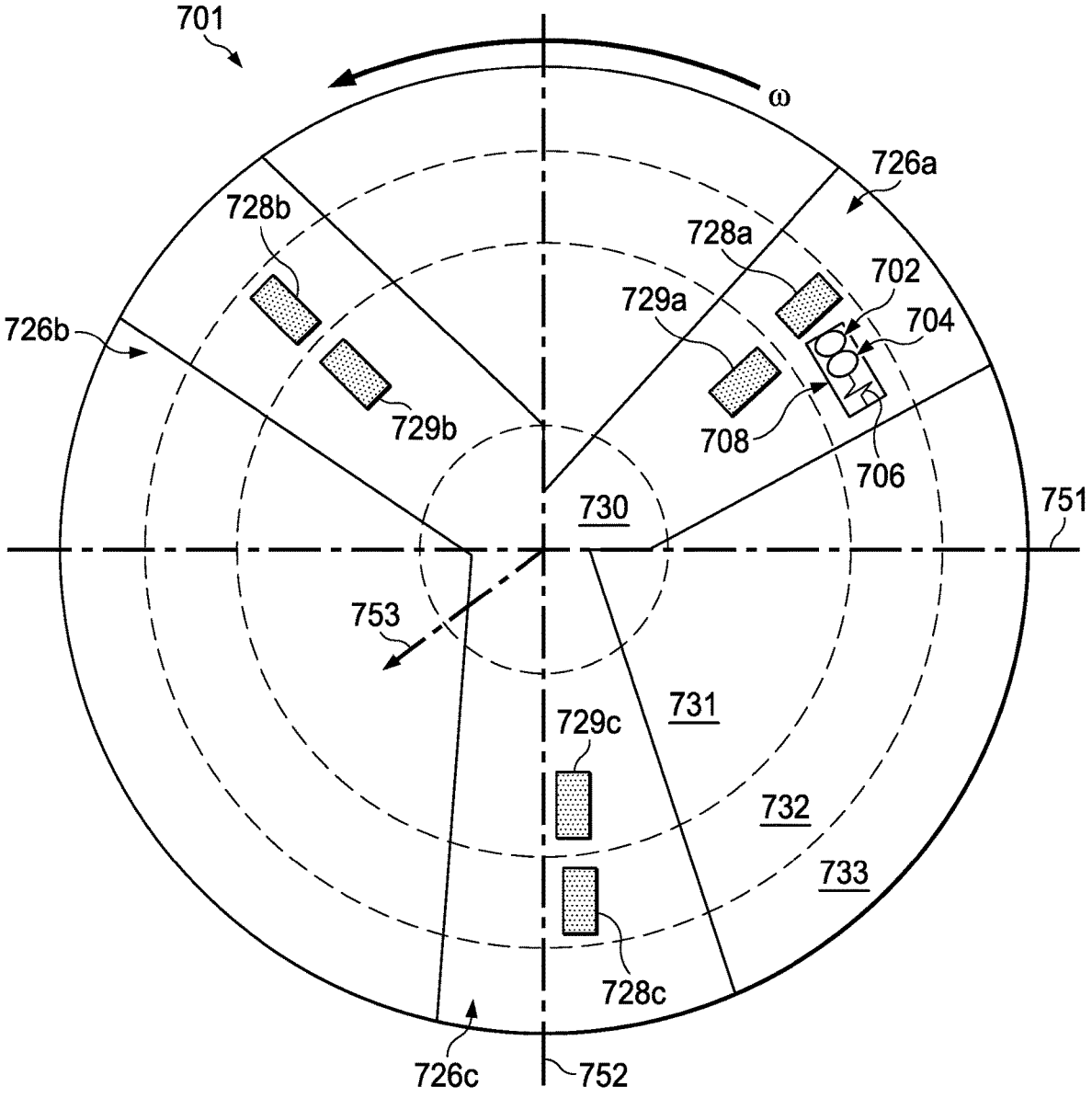
Figure 7F:
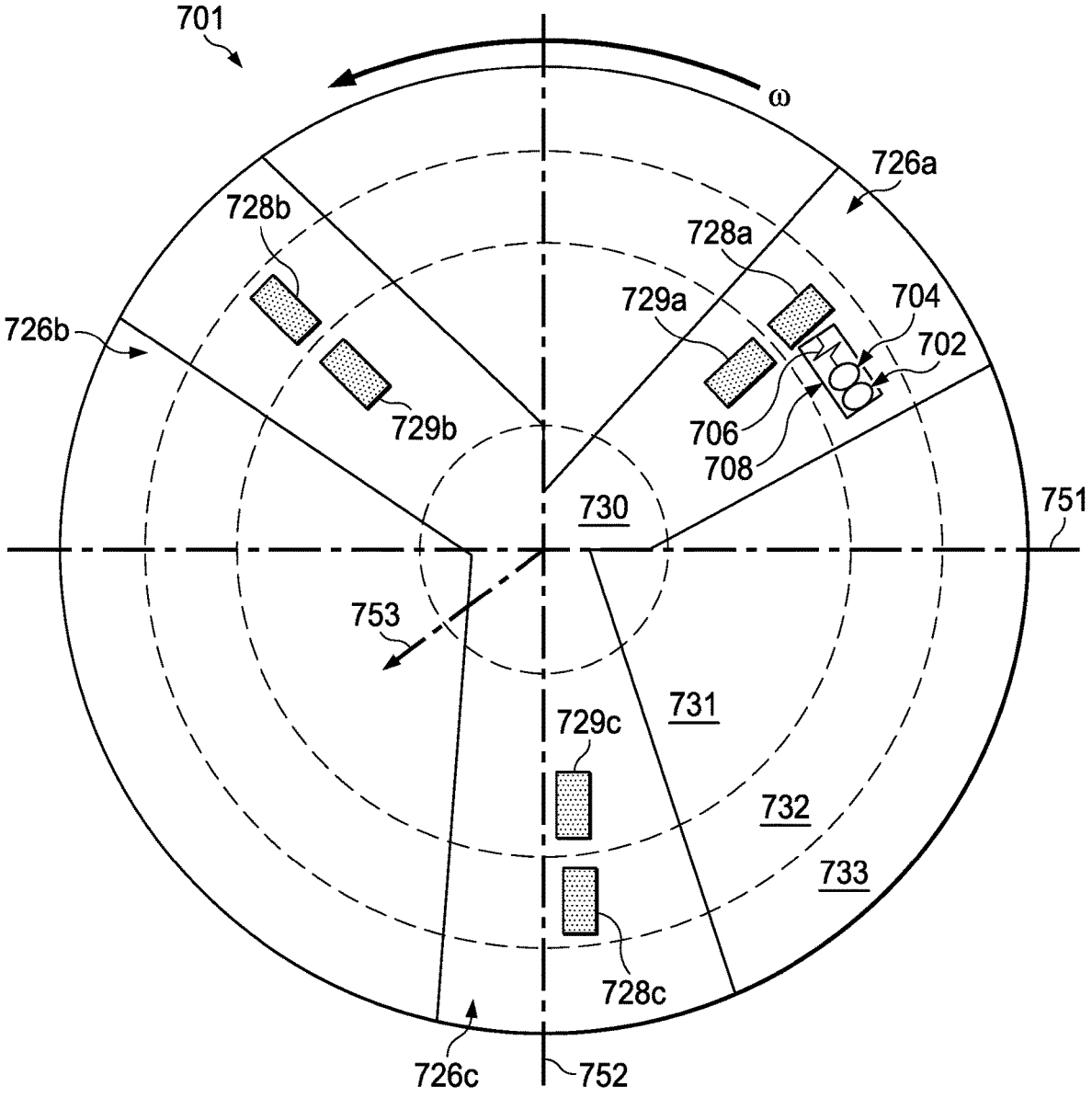

FIGS. 7D-7F illustrate orientations of a DOCC assembly in a shoulder zone of a drill bit. Although not expressly illustrated in FIGS. 7D-7F, the following description is also applicable to DOCC assemblies in a gage zone of a drill bit. As illustrated in FIG. 7D, DOCC assembly 708 may be located in shoulder zone 732. Because a frictional force acting on a shoulder zone or a gage zone of a drill bit may include a component directed toward bit rotational axis 753, DOCC assembly 708 may be oriented so that primary DOCC 702 is further away from the bit rotational axis 753 than secondary DOCC 708, primary DOCC 702 is closer to the outer edge of the face of drill bit 701, and secondary DOCC 704 is closer to bit rotational axis 753.

DOCC assembly 708 may be rotated between approximately 0 degrees and 90 degrees in either the counterclockwise or clockwise direction from the location illustrated in FIG. 7D. For example, FIG. 7E illustrates the face of a drill bit including DOCC assembly 708 located on drill bit 701. In FIG. 7E the orientation of DOCC assembly 708 is rotated approximately 90 degrees clockwise from the orientation of DOCC assembly 708 illustrated in FIG. 7D. As shown in FIG. 7D, secondary DOCC 704 is track set with primary DOCC 702 and trails primary DOCC 702 in the direction of rotation of the drill bit. Likewise, FIG. 7F illustrates the face of a drill bit including DOCC assembly 708 located on drill bit 701. In FIG. 7F the orientation of DOCC assembly 708 is rotated approximately 90 degrees counterclockwise from the orientation of DOCC assembly 708 illustrated in FIG. 7D. As shown in FIG. 7F, primary DOCC 702 is track set with secondary DOCC 704 and trails secondary DOCC 704 in the direction of rotation of the drill bit.

DOCC assemblies may be affixed to a downhole drilling tool such that a primary DOCC and a secondary DOCC are track set with one or more cutting elements. A first element on a downhole drilling tool may be said to be track set with a second element on a downhole drilling tool when the radial swath formed by a path of rotation of the first element is the same as the radial swath of the section element. For example, two elements may be said to track set where a first radial swath associated with a first element substantially overlaps a second radial swath associated with a second element. As a further example, two elements may be said to be track set where the elements have radial correspondence such that they are located on a bit face at the same radial position with respect to the bit rotational axis.

DOCC assemblies may be located on a downhole drilling tool in a wide variety of configurations. For example, a DOCC assembly may be located such that a primary DOCC and secondary DOCC are track set with a cutting element on the same blade as a DOCC assembly. Furthermore, a DOCC assembly may be located such that a primary DOCC and secondary DOCC are track set with a cutting element on a different blade than the DOCC assembly. Additionally, a DOCC assembly may be located such that a primary DOCC is track set with a first cutting element on the same blade as the DOCC assembly, and the secondary DOCC assembly is track set with a second cutting element on the same blade as the DOCC assembly. Moreover, a DOCC assembly may be located such that a primary DOCC is track set with a first cutting element on a different blade than the DOCC assembly, and the secondary DOCC assembly is track set with a second cutting element on the same blade as the DOCC assembly. Also, a DOCC assembly may be located such that primary DOCC is track set with a first cutting element on a different blade than the DOCC assembly, and the secondary DOCC assembly is track set with a second cutting element on a different blade than the DOCC assembly and the first cutting element. Likewise, a DOCC assembly may be located such that primary DOCC is track set with a first cutting element on a different blade than the DOCC assembly, and the secondary DOCC assembly is track set with a second cutting element on the same blade as the first cutting element.

Embodiments herein may include:

A. A drill bit including a bit body defining a rotational axis, a plurality of blades on the bit body, a plurality of cutting elements on the plurality of blades, each cutting element defining a sweep profile about the rotational axis, a first depth of cut controller (DOCC) movably secured to one of the plurality of blades and movable in response to contact by a formation when drilling, and a second DOCC movably secured to the one of the plurality of blades, the second DOCC coupled to the first DOCC such that movement of the first DOCC changes a height of the second DOCC relative to a height of the first DOCC.

B. A DOCC assembly including a housing, a first depth of cut controller (DOCC) movably secured to the housing and movable relative to the housing in response to contact by a formation when drilling, and a second DOCC movably secured to the housing, the second DOCC coupled to the first DOCC such that movement of the first DOCC changes a height of the second DOCC relative to a height of the first DOCC.

Both of embodiments A and B may have one or more of the following additional elements in any combination: The second DOCC includes a bottom surface in sliding contact with a ramp, and the first DOCC is movable laterally toward the second DOCC such that the movement of the first DOCC causes the second DOCC to slide up the ramp to increase the height of the second DOCC relative to the height of the first DOCC. The ramp is integral with the first DOCC, the second DOCC is coupled to the first DOCC by the bottom surface of the second DOCC in sliding contact with the ramp, and the first DOCC is movable laterally toward the second DOCC such that the ramp moves laterally beneath the second DOCC and causes the second DOCC to slide up the ramp to increase the height of the second DOCC relative to the height of the first DOCC. The drill bit further includes an elastic member secured to the one of the plurality of blades and to the second DOCC, the elastic member is capable of applying a biasing force to the second DOCC, and the second DOCC is capable of transferring a force to the first DOCC, the force opposing movement of the first DOCC. The ramp is coupled to the one of the plurality of blades, the drill bit further includes a flat surface adjacent to the ramp, the second DOCC is in sliding contact with the ramp, the first DOCC is in sliding contact with the flat surface, the second DOCC is coupled to the first DOCC by a spacing member to fix a distance between the first DOCC and the second DOCC, and the first DOCC is movable laterally toward the second DOCC such that the first DOCC and the spacing member cause the second DOCC to slide up the ramp to increase the height of the second DOCC relative to the height of the first DOCC. The drill bit further includes an elastic member secured to the one of the plurality of blades and to the second DOCC, the elastic member is capable of applying a biasing force to the second DOCC, and the second DOCC is capable of transferring a force to the first DOCC through the spacing member, the force opposing movement of the first DOCC. The drill bit further including a track movably securing the first DOCC to the one of the plurality of blades. The track is oriented such that the first DOCC moves along the track at a constant height relative to the one of the plurality of blades. The second DOCC is coupled to the first DOCC by a toggle pivotably coupled to the one of the plurality of blades, the first DOCC and the second DOCC are coupled to the toggle such that a pivot point of the toggle is located between the first DOCC and the second DOCC, and the first DOCC is movable such that the first DOCC causes the toggle to pivot about the pivot point to change the height of the second DOCC relative to the height of the first DOCC. The drill bit further includes an elastic member coupled to the one of the plurality of blades and to the toggle at a point between the pivot point and the first DOCC, the first DOCC is movable toward the elastic member, and the elastic member is capable of applying a biasing force to the toggle that opposes movement of the first DOCC. The first and second DOCCs are positioned away from the pivot point such that, when the height of the first DOCC changes, the height of the second DOCC changes relative to a height of one of the plurality of cutting elements. The first DOCC is movable such that the height of the first DOCC is substantially the same as the height of the second DOCC when a force resulting from the contact by the formation reaches a force threshold. The drill bit further includes a housing coupled to a cavity within the one of the plurality of blades and enclosing the first DOCC and the second DOCC. The first DOCC is track set with the second DOCC and trails the second DOCC in a direction of rotation of the drill bit. The second DOCC is track set with the first DOCC and trails the first DOCC in a direction of rotation of the drill bit. The first DOCC is movably secured closer to an outer edge of the drill bit than the second DOCC, and the second DOCC is movably secured closer to the rotational axis. The first DOCC is movably secured closer to the rotational axis than the second DOCC, and the first DOCC and the second DOCC are in a cone zone of the drill bit. The second DOCC is movably secured closer to the rotational axis than the first DOCC, and the first DOCC and the second DOCC are in a shoulder zone of the drill bit. The first DOCC is movably secured closer to the rotational axis than the second DOCC, and the first DOCC and the second DOCC are in a nose zone of the drill bit. The elastic member includes one of a coil spring, a torsional spring, a Belleville spring, a wave spring, a hydraulic element, a pneumatic element, or a low modulus material. The DOCC assembly further includes an elastic member secured to the housing and to the second DOCC, the elastic member is capable of applying a biasing force to the second DOCC, and the second DOCC is capable of transferring a force to the first DOCC, the force opposing movement of the first DOCC. The ramp is coupled to the housing, the DOCC assembly further includes a flat surface adjacent to the ramp, the second DOCC is in sliding contact with the ramp, the first DOCC is in sliding contact with the flat surface, the second DOCC is coupled to the first DOCC by a spacing member to fix a distance between the first DOCC and the second DOCC, and the first DOCC is movable laterally toward the second DOCC such that the first DOCC and the spacing member cause the second DOCC to slide up the ramp to increase the height of the second DOCC relative to the height of the first DOCC. The DOCC assembly further includes an elastic member secured to the housing and to the second DOCC, the elastic member is capable of applying a biasing force to the second DOCC, and the second DOCC is capable of transferring a force to the first DOCC through the spacing member, the force opposing movement of the first DOCC. The DOCC assembly further includes a track movably securing the first DOCC to the housing. The track is oriented such that the first DOCC moves along the track at a constant height relative to the housing. The second DOCC is coupled to the first DOCC by a toggle pivotably coupled to the housing, the first DOCC and the second DOCC are coupled to the toggle such that a pivot point of the toggle is located between the first DOCC and the second DOCC, and the first DOCC is movable such that the first DOCC causes the toggle to pivot about the pivot point to change the height of the second DOCC relative to the height of the first DOCC. The DOCC assembly further includes an elastic member coupled to the housing and to the toggle at a point between the pivot point and the first DOCC, the first DOCC is movable toward the elastic member, and the elastic member is capable of applying a biasing force to the toggle that opposes movement of the first DOCC. The first DOCC is movable such that the height of the first DOCC is substantially the same as the height of the second DOCC when a force generated by the contact by the formation reaches a force threshold. The elastic member includes one of a coil spring, a torsional spring, a Belleville spring, a wave spring, a hydraulic element, a pneumatic element, or a low modulus material.

What is claimed is:

1. A drill bit, comprising:

a bit body defining a rotational axis;

a plurality of blades on the bit body;

a plurality of cutting elements on the plurality of blades, each cutting element defining a sweep profile about the rotational axis;

a first depth of cut controller (DOCC) movably secured to one of the plurality of blades and movable in response to contact by a formation when drilling; and a second DOCC movably secured to the one of the plurality of blades, the second DOCC coupled to the first DOCC such that movement of the first DOCC changes a height of the second DOCC relative to a height of the first DOCC, wherein the first DOCC and the second DOCC are configured to control a depth of cut of the plurality of cutting elements.

2. The drill bit of claim 1, wherein:

the second DOCC includes a bottom surface in sliding contact with a ramp; and the first DOCC is movable laterally toward the second DOCC such that the movement of the first DOCC causes the second DOCC to slide up the ramp to increase the height of the second DOCC relative to the height of the first DOCC.

3. The drill bit of claim 2, wherein:

the ramp is integral with the first DOCC;

the second DOCC is coupled to the first DOCC by the bottom surface of the second DOCC in sliding contact with the ramp; and the first DOCC is movable laterally toward the second DOCC such that the ramp moves laterally beneath the second DOCC and causes the second DOCC to slide up the ramp to increase the height of the second DOCC relative to the height of the first DOCC.

4. The drill bit of claim 3, wherein:

the drill bit further comprises an elastic member secured to the one of the plurality of blades and to the second DOCC;

the elastic member is capable of applying a biasing force to the second DOCC; and the second DOCC is capable of transferring a force to the first DOCC, the force opposing movement of the first DOCC.

5. The drill bit of claim 4, wherein the elastic member comprises one of a coil spring, a torsional spring, a Belleville spring, a wave spring, a hydraulic element, a pneumatic element, or a low modulus material.

6. The drill bit of claim 2, wherein:

the ramp is coupled to the one of the plurality of blades;

the drill bit further comprises a flat surface adjacent to the ramp;

the second DOCC is in sliding contact with the ramp;

the first DOCC is in sliding contact with the flat surface;

the second DOCC is coupled to the first DOCC by a spacing member to fix a distance between the first DOCC and the second DOCC; and the first DOCC is movable laterally toward the second DOCC such that the first DOCC and the spacing member cause the second DOCC to slide up the ramp to increase the height of the second DOCC relative to the height of the first DOCC.

7. The drill bit of claim 6, wherein:

the drill bit further comprises an elastic member secured to the one of the plurality of blades and to the second DOCC;

the elastic member is capable of applying a biasing force to the second DOCC; and the second DOCC is capable of transferring a force to the first DOCC through the spacing member, the force opposing movement of the first DOCC.

8. The drill bit of claim 1, further comprising a track movably securing the first DOCC to the one of the plurality of blades, the track oriented such that the first DOCC moves along the track at a constant height relative to the one of the plurality of blades.

9. The drill bit of claim 1, wherein:

the second DOCC is coupled to the first DOCC by a toggle pivotably coupled to the one of the plurality of blades;

the first DOCC and the second DOCC are coupled to the toggle such that a pivot point of the toggle is located between the first DOCC and the second DOCC; and the first DOCC is movable such that the first DOCC causes the toggle to pivot about the pivot point to change the height of the second DOCC relative to the height of the first DOCC.

10. The drill bit of claim 9, wherein:

the drill bit further comprises an elastic member coupled to the one of the plurality of blades and to the toggle at a point between the pivot point and the first DOCC;

the first DOCC is movable toward the elastic member; and the elastic member is capable of applying a biasing force to the toggle that opposes movement of the first DOCC.

11. The drill bit of claim 9, wherein:

the first and second DOCCs are positioned away from the pivot point such that, when the height of the first DOCC changes, the height of the second DOCC changes relative to a height of one of the plurality of cutting elements.

12. The drill bit of claim 1, wherein:

the first DOCC is movable such that the height of the first DOCC is substantially the same as the height of the second DOCC when a force resulting from the contact by the formation reaches a force threshold.

13. The drill bit of claim 1, wherein the drill bit further comprises a housing coupled to a cavity within the one of the plurality of blades and enclosing the first DOCC and the second DOCC.

14. The drill bit of claim 1, wherein the first DOCC is movably secured closer to an outer edge of the drill bit than the second DOCC, and the second DOCC is movably secured closer to the rotational axis.

15. A DOCC assembly, comprising:

a housing;

a first depth of cut controller (DOCC) movably secured to the housing and movable relative to the housing in response to contact by a formation when drilling; and a second DOCC movably secured to the housing, the second DOCC coupled to the first DOCC such that movement of the first DOCC changes a height of the second DOCC relative to a height of the first DOCC, wherein the first DOCC and the second DOCC are configured to control a depth of cut of the plurality of cutting elements.

16. The DOCC assembly of claim 15, wherein:

the second DOCC includes a bottom surface in sliding contact with a ramp;

the ramp is integral with the first DOCC;

the second DOCC is coupled to the first DOCC by the bottom surface of the second DOCC in sliding contact with the ramp;

the first DOCC is movable laterally toward the second DOCC such that the ramp moves laterally beneath the second DOCC and causes the second DOCC to slide up the ramp to increase the height of the second DOCC relative to the height of the first DOCC;

the DOCC assembly further comprises an elastic member secured to the housing and to the second DOCC;

the elastic member is capable of applying a biasing force to the second DOCC; and the second DOCC is capable of transferring a force to the first DOCC, the force opposing movement of the first DOCC.

17. The DOCC assembly of claim 16, wherein the elastic member comprises one of a coil spring, a torsional spring, a Belleville spring, a wave spring, a hydraulic element, a pneumatic element, or a low modulus material.

18. The DOCC assembly of claim 15, wherein:

the second DOCC includes a bottom surface in sliding contact with a ramp;

the ramp is coupled to the housing;

the DOCC assembly further comprises a flat surface adjacent to the ramp;

the first DOCC is in sliding contact with the flat surface;

the second DOCC is coupled to the first DOCC by a spacing member to fix a distance between the first DOCC and the second DOCC;

the first DOCC is movable laterally toward the second DOCC such that the first DOCC and the spacing member cause the second DOCC to slide up the ramp to increase the height of the second DOCC relative to the height of the first DOCC;

the DOCC assembly further comprises an elastic member secured to the housing and to the second DOCC;

the elastic member is capable of applying a biasing force to the second DOCC; and the second DOCC is capable of transferring a force to the first DOCC through the spacing member, the force opposing movement of the first DOCC.

19. The DOCC assembly of claim 15, further comprising a track movably securing the first DOCC to the housing, the track oriented such that the first DOCC moves along the track at a constant height relative to the housing.

20. The DOCC assembly of claim 15, wherein:

the second DOCC is coupled to the first DOCC by a toggle pivotably coupled to the housing;

the first DOCC and the second DOCC are coupled to the toggle such that a pivot point of the toggle is located between the first DOCC and the second DOCC;

the first DOCC is movable such that the first DOCC causes the toggle to pivot about the pivot point to change the height of the second DOCC relative to the height of the first DOCC;

the DOCC assembly further comprises an elastic member coupled to the housing and to the toggle at a point between the pivot point and the first DOCC;

the first DOCC is movable toward the elastic member; and the elastic member is capable of applying a biasing force to the toggle that opposes movement of the first DOCC.

21. The DOCC assembly of claim 15, wherein:

the first DOCC is movable such that the height of the first DOCC is substantially the same as the height of the second DOCC when a force generated by the contact by the formation reaches a force threshold.

* * * * *